US010274239B2

(12) United States Patent
Kobayashi et al.

(10) Patent No.: US 10,274,239 B2
(45) Date of Patent: Apr. 30, 2019

(54) AUTOMATIC ICE MAKER

(71) Applicant: Hoshizaki Corporation, Toyoake-shi, Aichi (JP)

(72) Inventors: Seiji Kobayashi, Toyoake (JP); Terumichi Hara, Toyoake (JP); Masumi Notsu, Toyoake (JP); Shizuma Kadowaki, Toyoake (JP); Minoru Nakao, Toyoake (JP)

(73) Assignee: Hoshizaki Corporation, Aichi (JP)

( * ) Notice: Subject to any disclaimer, the term of this patent is extended or adjusted under 35 U.S.C. 154(b) by 0 days.

(21) Appl. No.: 15/541,256

(22) PCT Filed: Mar. 15, 2016

(86) PCT No.: PCT/JP2016/058191

§ 371 (c)(1),
(2) Date: Jun. 30, 2017

(87) PCT Pub. No.: WO2016/181702

PCT Pub. Date: Nov. 17, 2016

(65) Prior Publication Data

US 2018/0023874 A1 Jan. 25, 2018

(30) Foreign Application Priority Data

May 14, 2015 (JP) ..... 2015-099249
May 14, 2015 (JP) ..... 2015-099250
May 14, 2015 (JP) ..... 2015-099251

(51) Int. Cl.

| | |
|---|---|
| ***F25C 1/22*** | (2018.01) |
| ***C23C 18/36*** | (2006.01) |
| ***F25C 1/045*** | (2018.01) |

(52) U.S. Cl.
CPC ..... *F25C 1/22* (2013.01); *C23C 18/36* (2013.01); *F25C 1/045* (2013.01); *F25C 2400/12* (2013.01); *F25C 2600/04* (2013.01)

(58) Field of Classification Search
CPC .... F25C 1/22; F25C 2400/12; F25C 2600/04; F25C 1/045; C23C 18/36
See application file for complete search history.

(56) References Cited

U.S. PATENT DOCUMENTS

2006/0207282 A1* 9/2006 Visin ..... F25C 1/10 62/351
2014/0226311 A1* 8/2014 Ono ..... F21V 5/04 362/97.1

FOREIGN PATENT DOCUMENTS

JP S52-142353 A 11/1977
JP 2003-528983 A 9/2003
(Continued)

*Primary Examiner* — Melvin Jones
(74) *Attorney, Agent, or Firm* — Norton Rose Fulbright US LLP

(57) ABSTRACT

[Task] To provide an automatic ice maker with improved corrosion resistance to prevent ice-making water and ice from being contaminated by a corrosion product such as rust, thereby enhancing the reliability of food sanitation.
[Means for solution] The automatic ice maker produces ice having a required shape by supplying ice-making water in circulation to an ice compartment 10 that is cooled by a cooling pipe 48. The automatic ice maker has an electroless nickel-phosphorus plated coating 23 formed in a thickness of 15 μm or more on an outermost layer of the ice compartment 10, which coating 23 contains a 10% to 15% phosphorus component.

7 Claims, 16 Drawing Sheets

(56) References Cited

FOREIGN PATENT DOCUMENTS

| | | | |
|---|---|---|---|
| JP | 2005-30702 | A | 2/2005 |
| JP | 2005-37060 | A | 2/2005 |
| JP | 2014-119167 | A | 6/2014 |

* cited by examiner

AUTOMATIC ICE MAKER

CROSS REFERENCE TO RELATED APPLICATIONS

This application is a National Stage of International Application No. PCT/JP2016/058191 filed on Mar. 15, 2016 and claims the benefit of priorities under 35 USC 119 of:

Japanese Patent Application No. 2015-99249, filed on May 14, 2015,

Japanese Patent Application No. 2015-99250, filed on May 14, 2015, and

Japanese Patent Application No. 2015-99251, filed on May 14, 2015, which are incorporated herein by reference.

TECHNICAL FIELD

The present invention relates to an automatic ice maker that continuously produces ice blocks by supplying ice-making water to an ice-making unit that is cooled by an evaporator, and, more specifically, to a coating capable of improving the corrosion resistance of the ice-making unit.

BACKGROUND ART

Automatic ice makers that continuously produce large quantities of ice blocks are suitably used in kitchens of facilities such as coffee shops and restaurants, and other kitchens. These automatic ice makers include an injection type automatic ice maker that continuously produces ice blocks of a required shape by supplying ice-making water, from below, to multiple small ice compartments that are open downward, and a flow-down type automatic ice machine that causes ice-making water to flow down on the top surface of an inclined ice-making plate to produce a plate of ice on the ice-making plate.

For example, as shown in FIG. 11, there is an injection type automatic ice maker that is provided with what is called a closed-cell type ice-making mechanism 13. The closed-cell type ice-making mechanism 13 is equipped with an ice compartment 10, as an ice-making unit, in which a large number of small ice compartments 12 open downward are defined, and a tiltable water tray 40 that is located below the ice compartment 10 and is pivotally supported on a support shaft 42. An ice-making water tank 44 for storing ice-making water supplied from a water supply section 43 is integrally provided at the bottom of the water tray 40. An evaporator 48 which is led out from a refrigeration system 46 is disposed in a meandering fashion on the upper surface of the ice compartment 10 so that a refrigerant from the refrigeration system 46 is supplied in circulation to the evaporator 48 to cool the ice compartment 10 to below the freezing point. The refrigeration system 46 includes a compressor CM, a condenser CD and an expansion valve EV. The discharge side of the compressor CM and the suction side of the evaporator 48 are connected by a bypass pipe 50 at which a hot gas valve HV is provided.

At the time of the ice-making operation of the automatic ice maker, ice-making water is injected to the individual small ice compartments 12 from the water tray 40 having the small ice compartments 12 closed from below to form ice blocks in the small ice compartments 12 that is cooled forcibly. At the time of the deicing operation, the water tray 40 is tilted obliquely downward to open the small ice compartments 12, and the hot gas valve HV is opened to supply hot gas from the compressor CM to the evaporator 48 to melt the frozen connection between the ice blocks and the small ice compartments 12 and drop the ice blocks into an underlying ice storage room by their own weights.

FIG. 12 is an exploded perspective view of the ice compartment 10 disposed in the injection type automatic ice maker. The ice compartment 10 fundamentally includes a box-shaped outer frame 14 that is open downward, and a lattice-shaped partition member 30 that is disposed in the outer frame 14 and defines the plurality of small ice compartments 12. Further, a cooling pipe 48 as the evaporator is disposed in close contact on the upper surface of the outer frame 14 in a meandering fashion. The ice compartment 10 is made by assembling the components such as the outer frame 14 formed in a required shape, the partition member 30 and the cooling pipe 48. That is, the ice compartment 10 is assembled by setting the partition member 30, assembled with a plurality of metal plates in a lattice shape, inside the outer frame 14 formed in a box shape by bending a metal plate, and disposing the cooling pipe 48 which is an elongated hollow pipe bent in a meandering fashion on the upper surface of the outer frame 14. Then, the outer frame 14 and the partition member 30 are joined together by means of caulking, brazing or the like, and the outer frame 14 and the cooling pipe 48 are joined by brazing. In the case of the caulking, projections 31 are provided at an upper portion of the partition member 30, caulking holes 16*a* are formed in the upper surface of the outer frame, and the projections 31, which are inserted into the caulking holes 16*a* to project from the upper surface of the outer frame 14, are crushed with a hammer or the like. Each of the partition plates 30*a*, 30*b*, which constitute the partition member 30, may be provided with an engagement piece, and engagement grooves that engage with the respective engagement pieces may be provided in those positions of the outer frame 14 which correspond to the engagement pieces to position both members 14, 30.

A metal material like copper having good heat conductivity is used for a basis material 17 (see FIG. 2) of the components of the ice compartment 10 such as the outer frame 14, the partition member 30 and the cooling pipe 48 to ensure good heat exchange with the refrigerant that circulates the interior of the cooling pipe 48. Since the basis material 17 made of copper or the like, which is excellent in heat conductivity, is easily rusted, a molten tin plated coating 11 is generally formed on the surface of the ice compartment 10 as an antirust treatment, as shown in enlargement in FIG. 2. The molten tin plated coating 11 is formed on the surface of the ice compartment 10 by entirely immersing the whole ice compartment 10, assembled with the individual components 14, 30, 48, in a tin bath mainly containing melted tin. This plating treatment may be performed separately for the individual components 14, 30, 48, in which case the ice compartment 10 is assembled with the individual components 14, 30, 48 which have been plated with molten tin. The automatic ice maker including an ice compartment subjected to the aforementioned molten tin plated coating on the surface is disclosed, for example, in Patent Document 1.

RELATED ART LITERATURE

Patent Literature

Patent Document 1: Japanese Unexamined Patent Publication No. 2005-30702

SUMMARY OF THE INVENTION

Problems to be Solved by the Invention

The molten tin plated coating is not easily rusted compared with the basis material made of copper or the like; however, when the use atmosphere contains an oxidizing substance or the like, a corrosion product such as rust may be produced with time. It is pointed out that since this corrosion product is easily peeled off from the molten tin plated coating, a problem such as mixing of the corrosion product into ice blocks can arise. Further, the molten tin plated coating has low resistance to disinfectants such as sodium hypochlorite and electrolytic acid water, so that the ice compartment having the coating formed thereon is not suitable in use in disinfection with these chemicals.

The present invention has been proposed to suitably solve the aforementioned inherent problem of the automatic ice maker according to the related art, and an object of the invention is to provide an automatic ice maker that has an ice-making unit with improved corrosion resistance.

The ice compartment 10, as illustrated in FIG. 12, includes the outer frame 14 having the rectangular top plate 16 and the side plates 18 surrounding the four sides of the top plate 16, and the partition member 30 that is located inside the outer frame 14 to define the multiple small ice compartments 12 in a lattice shape. In this case, the outer frame 14 and the partition member 30 are assembled by means of caulking by inserting the projections 31 projecting from the required locations of the partition member 30 into the respective caulking holes 16*a* respectively bored in the top plate 16, and then crashing the heads of the projections 31. However, caulking is carried out merely by the plurality of projections 31 inserted into the caulking holes 16*a*. Accordingly, since large expansion pressure caused when ice blocks grow in each small ice compartment 12 is applied thereto every time the ice-making operation is performed, there is a drawback that coupling between the outer frame 14 and the partition member 30 may become loose with time. In this case, various surface treatments applied to the ice compartment 10 are undesirably degraded or peeled off, thereby lowering the durability.

To improve this, the fitting portion between the caulking holes 16*a* bored in the top plate 16 and the projections 31 of the partition member 30 are joined by soldering or brazing. However, the outer frame 14 and the partition member 30 are generally made of copper which is a good heat conductor, so that when they are exposed to a high temperature during the brazing, copper is undesirably softened and deformed. In order to avoid a reduction in strength due to such softening, it is conceivable to use a brazing material with a low melting point, this brazing material is more expensive than brazing materials commonly used, thus increasing the cost, In addition, since ice-making water is cyclically injected into the ice compartment 10 to form ice blocks inside each small ice compartment 12, a surface treatment with molten tin plating is generally employed from the viewpoint of food sanitation. Although the coating 11 according to this molten tin plating is relatively difficult to rust, if the use atmosphere of the ice maker contains a substance such as an oxidizing substance that promotes corrosion, a corrosion product such as rust may be produced on the outer frame 14 and the partition member 30 with time. Such a corrosion product is easily peeled off from the molten tin plated coating 11, so that this corrosion product, if mixed into ice-making water or produced ice blocks, may become a food sanitation problem.

Accordingly, an object of another aspect of the present invention in the present application is to improve the corrosion resistance as compared with the conventional surface treatment with molten tin plating by applying an electroless nickel-phosphorus plated coating to the outer frame and the partition member that constitute the ice compartment, in an injection type ice maker of what is called a closed-cell type that injects ice-making water into the individual small ice compartments of the ice compartment with the ice compartment closed with a water tray from below

Means for Solving the Problems

To overcome the above problems and achieve the intended objects, the gist of the invention set forth in claim 1 is an automatic ice maker for producing ice having a required shape by supplying ice-making water in circulation to an ice compartment that is cooled by an evaporator, wherein an electroless nickel-phosphorus plated coating containing a 10% to 15% phosphorus component is formed in a thickness of 15 μm or more on an outermost layer of the ice compartment.

According to the invention set forth in claim 1, the electroless nickel phosphorus plated coating formed on the outermost layer of the ice compartment can improve the corrosion resistance of the ice compartment. Even in a use atmosphere where corrosion is progressed in the conventional ice compartment, therefore, the occurrence of corrosion is prevented, thus ensuring production of ice. Further, since the corrosion resistance to disinfectants is also high, it is possible to keep the sanitation of the ice compartment through maintenance with a disinfectant.

The gist of the invention set forth in claim 2 is such that the electroless nickel-phosphorus plated coating is directly formed, on an outer surface of a basis material of the ice compartment.

According to the invention set forth in claim 2, the electroless nickel-phosphorus plated coating formed on the outermost layer of the ice compartment improves the corrosion resistance of the ice compartment, so that it is not necessary to apply a multi-layer coating to the basis material in order to prevent corrosion of the basis material, thereby enhancing the manufacturing efficiency.

To overcome the above problems and achieve the intended objects, the gist of the invention set forth in claim 3 is an automatic ice maker including an ice compartment having a plurality of small ice compartments defined by disposing a partition member formed by assembling a plurality of horizontal partition plates and vertical partition plates in a lattice shape to an outer frame including a top plate and side plates, the small ice compartments being open downward; an evaporator disposed on the top plate of the outer frame and cooling the ice compartment by circulating a refrigerant supplied from a refrigeration system; and a water tray openably closing the ice compartment from under to supply ice-making water to each of the corresponding small ice compartments, wherein an electroless nickel-phosphorus plated coating is applied to the ice compartment including the partition member and the outer frame.

According to the invention set forth in claim 3, even when an oxidizing substance which promotes corrosion is present in the use atmosphere of a site where a closed-cell type of injection type ice maker runs, possible production of a corrosion product due to rusting in the ice compartment is reduced.

The gist of the invention set forth in claim 4 is that a portion of the partition member joined to the top plate of the outer frame is formed straight, and the partition member and the top plate are joined together by brazing with a soft solder or a hard solder.

According to the invention set forth in claim 4, since it is not necessary to perform processing for caulking to the partition member and the top plate of the outer frame, the number of manufacturing steps can be reduced.

The gist of the invention set forth in claim 5 is that joining the partition member and the top plate by the hard solder is achieved by furnace brazing in a heating furnace.

According to the invention set forth in claim 5, overall heating of the partition member and the top plate of the outer frame can be achieved by furnace heating, so that thermal distortion due to local heating does not occur. This eliminates the need for a distortion correcting operation as post-processing.

Effects of the Invention

According to the automatic ice maker according to the present invention, the corrosion resistance of the ice compartment is improved, so that a corrosion product such as rust is not mixed into ice-making water and ice, thus ensuring enhanced reliability of food sanitation.

According to the closed-cell type of injection type ice maker according to another aspect of the present invention, the corrosion resistance of the ice compartment to which a surface treatment is applied can be improved significantly, so that possible mixing of a corrosion product such as rust into ice-making water and ice blocks is prevented even over a long period of usage.

BRIEF DESCRIPTION OF DRAWINGS

FIG. 1A shows an electroless nickel-phosphorus plated coating formed on the outer surface of a basis material, FIG. 1B shows a base layer provided under the electroless nickel-phosphorus plated coating in FIG. 1A, and FIG. 1C shows an adjustment layer provided between the basis material and the base layer of FIG. 1B.

FIG. 4A shows a state before the side plates are bent with respect to the top plate, and FIG. 4B shows a state where the side plates are bent with respect to the top plate.

FIG. 6A shows a state before the side plates are bent with respect to the top plate, and FIG. 6B shows a state where the side plates are bent with respect to the top plate and represents, in a two-dot chain line, the extending portion bent along the second side plates.

FIG. 8A shows a state before the side plates are bent with respect to the top plate, FIG. 8B is a side view of FIG. 7B showing a state where the side plates are bent with respect to the top plate, and FIG. 8C is a side view of FIG. 7A showing a state where the extending portion is pressed.

FIG. 10A shows a state before the side plates are bent with respect to the top plate, and FIG. 10B shows a state where bending of the side plates with respect to the top plate is in progress.

MODE FOR CARRYING OUT THE INVENTION

Figure 1A:
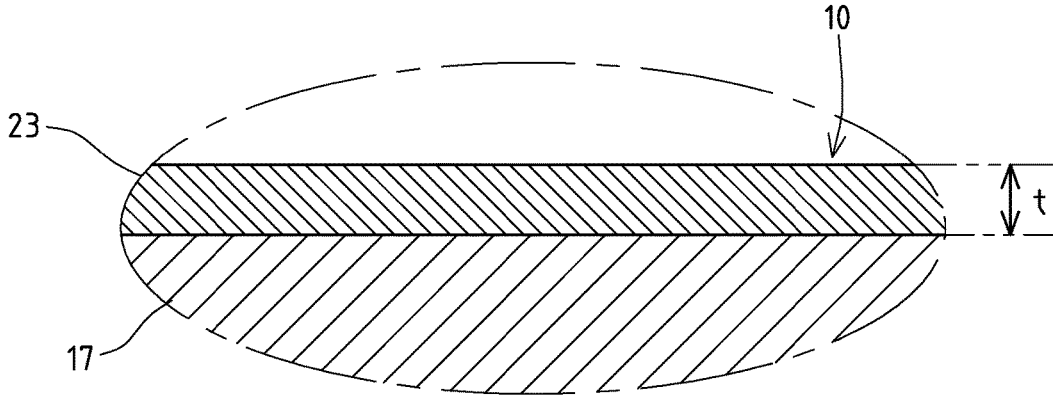
FIGS. 1A to 1C are enlarged cross-sectional views of a surface layer portion of an ice compartment according to an embodiment.

Next, a preferred embodiment of an automatic ice maker according to the present invention is described with reference to the accompanying drawings. In the embodiment, an ice compartment which is used in what is called the closed-cell type of injection-type automatic ice maker is described as an ice-making unit. The ice-making unit may be the ice compartment of what is called the open-cell type of injection type automatic ice maker that injects ice-making water without the intervention of a water tray, or the ice-making plate of the flow-down type automatic ice maker that causes ice-making water to flow down on the ice-making surface. Since the fundamental structure of the ice compartment to be described in connection to the embodiment, is common to the structure of the conventional ice compartment described with reference to FIG. 12, same reference numerals are used for the components described already.

Embodiments (Automatic Ice Maker)

The automatic ice maker according to the embodiment, like the conventional ice compartment 10 described with reference to FIG. 12, supplies ice-making water in circulation to an ice compartment 10 that is cooled by a cooling pipe 48 serving as an evaporator to generate the ice of the required shape. The ice compartment 10 fundamentally includes a box-shaped outer frame 14 which is open downward, and a lattice-shaped partition member 30 that is disposed within the outer frame 14 to define a plurality of small ice compartments 12, with a cooling pipe 48 being disposed on the top surface of the outer frame 14 in close contact therewith in a meandering fashion.

(Ice Compartment 10)

Figure 1B:
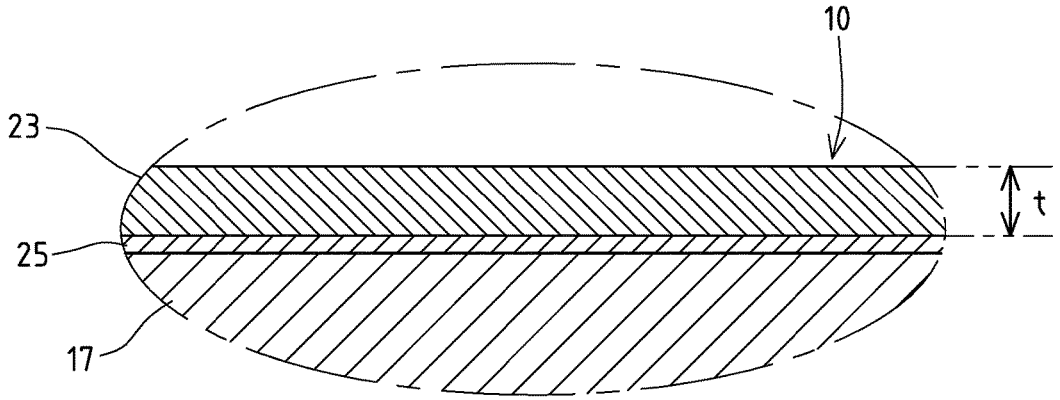
Figure 1C:
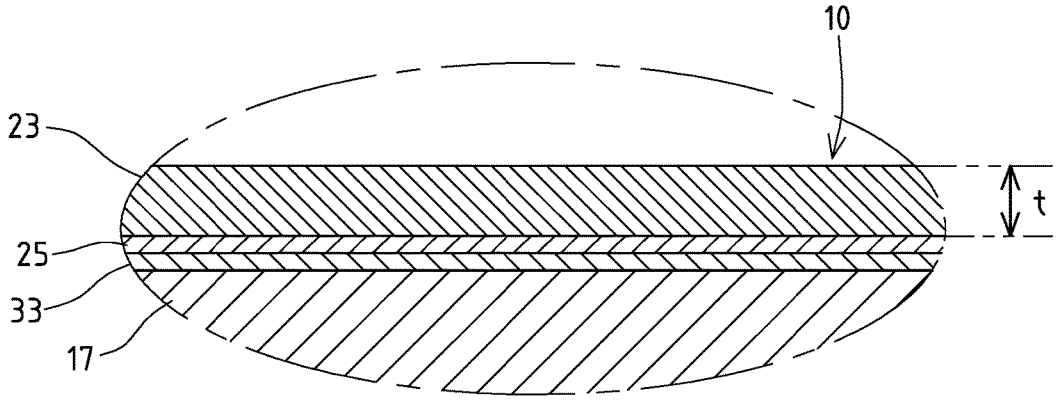
Figure 2:
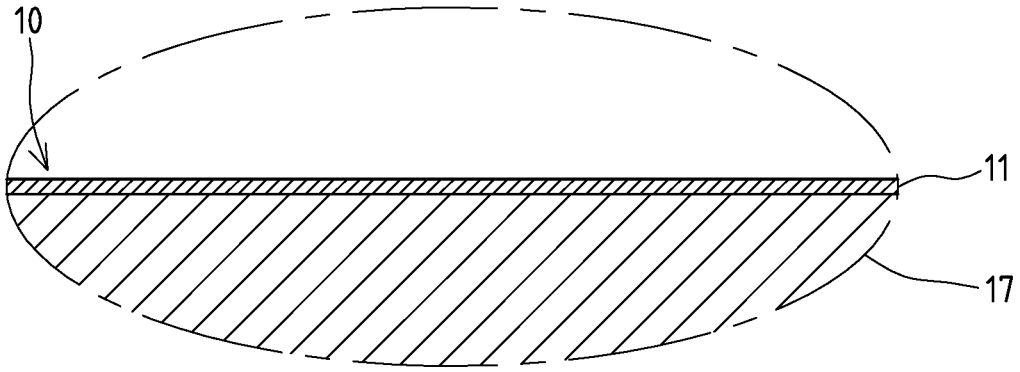
FIG. 2 is an enlarged cross-sectional view of the surface layer portion of the ice compartment.

The materials for the box-shaped outer frame 14, the lattice-shaped partition member 30 and the cooling pipe 48, which constitute the ice compartment 10, are metals, alloys or the like having an excellent heat conductivity, such as copper, and an electroless nickel-phosphorus plated coating 23 is formed on the outermost layer of a basis material 17 of each of the constituents, as shown in FIGS. 1A to 1C. The outermost layer of the ice compartment 10 is a layer formed on that surface of the ice compartment 10 which is exposed to the outside. Note that a part of the exposed surface of the ice compartment 10 may have a region where the electroless nickel-phosphorus plated coating 23 is not formed. The electroless nickel-phosphorus plated coating 23 may be provided in contact with the outer surface of the basis material 17, as shown in FIG. 1A, or a base layer 25 including a plated coating of nickel, palladium or the like may be provided under the coating 23 as the base of the electroless nickel-phosphorus plated coating 23, as shown in FIG. 1B. Furthermore, as shown in FIG. 1C, an adjustment layer 33 including a plated coating of copper or the like may be provided on the surface of the basis material 17 in order to smoothen the surface of the basis material 17. If the basis material 17 contains an element such as tin or lead which inhibits the deposition of nickel in electroless nickel-phosphorus plating treatment to be described later, it is preferable to form the base layer 25 on the surface of the basis material 17. In other words, the base layer 25 and the adjustment layer 33 are formed as needed according to the surface condition of the basis material 17, the surface condition of the base layer applied by the electroless nickel-phosphorus plated coating 23 or the like. The thickness of the base layer 25 and the adjustment layer 33 which are not exposed to the outer surface of the ice compartment 10 may be approximately 1 μm.

(Electroless Nickel-Phosphorus Plated Coating 23)

The electroless nickel-phosphorus plated coating 23 which is formed on the outermost layer of the ice compartment 10 is of what is called a high-phosphorus type that contains a phosphorus component of 10% to 15% (percent by mass concentration, this means the same hereinafter). Further, as shown in FIGS. 1A to 1C, the electroless nickel-phosphorus plated coating 23 is formed so as to have a thickness t of 15 μm or more. In addition, it has been confirmed through a corrosion resistance confirmation test to be described later that setting the thickness t of the electroless nickel-phosphorus plated coating 23 to 15 μm or more prevents the occurrence of pinholes reaching the basis material 17 or the base layer 25 and the adjustment layer 33.

(Electroless Nickel-Phosphorus Plating Treatment)

Now, the electroless nickel-phosphorus plating treatment to form the electroless nickel-phosphorus plated coating 23 is described. The electroless nickel-phosphorus plating treatment is carried out through what is called dipping by which the ice compartment 10 is entirely dipped in the reservoir of a nickel-phosphorus plating solution which contains, as main components, a metallic salt containing nickel such as nickel sulfate, and a reducing agent such as sodium hypophosphite. The nickel-phosphorus plating solution is adjusted in such a way that the concentration of the phosphorus component in the electroless nickel-phosphorus plated coating 23 to be formed becomes 10% to 15%. Further, a necessary catalyst may be added to the nickel-phosphorus plating solution. Note that when the adjustment layer 33 or the base layer 25 is provided between the basis material 17 and the electroless nickel-phosphorus plated coating 23, electroless nickel-phosphorus plating treatment is performed after the adjustment layer 33 and the base layer 25 are treated. As nickel cations derived from the metallic salt are reduced and deposited on the outermost layer of the ice compartment 10 dipped in the reservoir, the electroless nickel-phosphorus plated coating 23 made of a nickel alloy is formed thereon. As mentioned above, the electroless nickel-phosphorus plating treatment, is performed until the thickness t of the electroless nickel-phosphorus plated coating 23 becomes 15 μm or more. In addition, the electroless nickel-phosphorus plating treatment may be performed individually for the constituting members such as the outer frame 14, the partition member 30 and the cooling pipe 48, after which the individual constituting members 14, 30 and 48 may be assembled.

Operation of the Embodiment

Next, the operation of the automatic ice maker according to the embodiment in FIGS. 1A to 1C is described. Since the electroless nickel-phosphorus plated coating 23 formed on the outermost layer of the ice compartment 10 is an alloy, the coating 23 is advantageous in that it will not be corroded at all by most of organic solvents, and has excellent corrosion resistance to organic acids, salts, and alkalis, and is hardly rusted. Moreover, setting the thickness t of electroless nickel-phosphorus plated coating 23 to 15 μm or more prevents the occurrence of pinholes that reach the basis material 17 or the base layer 25 and the adjustment layer 33, so that the aforementioned excellent corrosion resistance can be provided sufficiently. Moreover, setting the concentration of the phosphorus component contained in the electroless nickel-phosphorus plated coating 23 to 10% to 15% provides excellent corrosion resistance as compared with the case where the concentration of the phosphorus component is set to 10% or less. Note that the corrosion resistance has been confirmed through the corrosion resistance confirmation test to be described later. The plated coating that is applied to the outermost layer of the ice compartment 10 generally has a thickness of 10 μm or less. This general thickness is derived from reasons such as the productional reason that the formation of the coating takes time, and a reduction in heat conductivity or easy peeling of the plated coating due to setting the thickness larger.

Since the ice compartment 10 according to the embodiment has excellent corrosion resistance as described above, the automatic ice maker can be installed to make ice even in the environment where corrosion proceeds in the conventional ice compartment 10 described with reference to FIG. 12. In addition, the electroless nickel-phosphorus plated coating 23 provides excellent corrosion resistance as described above, and is thus less likely to be corroded by disinfectants such as sodium hypochlorite and electrolytic acid water. Therefore, it is possible to perform maintenance such as disinfection using the disinfectants, and the ice compartment 10 can be kept more hygienic. In addition, the corrosion resistance of the ice compartment 10 is enhanced by the electroless nickel-phosphorus plated coating 23, a coating which is otherwise applied to the underlayer of the electroless nickel-phosphorus plated coating 23 for the purpose of preventing the corrosion of the basis material 17 may be omitted. Accordingly, even when the electroless nickel-phosphorus plated coating 23 is formed directly on the outer surface of the basis material 17 as shown in FIG. 1A, the occurrence of corrosion can be effectively prevented. That is, when the electroless nickel-phosphorus plated coating 23 is formed on the outer surface of the basis material 17 to contact with each other, it is possible to reduce the labor required for the surface treatment of the ice compartment 10, which leads to an expected effect of enhancing the production efficiency. When a multi-layer coating is applied, as shown in FIGS. 1B and 1C, the reliability of preventing corrosion is enhanced.

EXPERIMENTAL EXAMPLES

The corrosion resistance confirmation test was conducted on the ice compartment 10 of the embodiment to confirm the corrosion resistance. Further, as shown in Table 1, the corrosion resistance confirmation test was also conducted on Comparative Example 1 in which the concentration of the contained phosphorus component, was 8%, Comparative Examples 2 and 3 in which the thickness t of the electroless nickel-phosphorus plated coating 23 was set thinner than 15 μm, and Comparative Examples 4 and 5 in which the molten tin plated coating 11 was applied in place of the electroless nickel-phosphorus plated coating 23. In Experimental Examples 1 to 6 and Comparative Examples 1 to 3, the test was conducted on specimens to which the electroless nickel-phosphorus plated coating 23 was applied. In the test, however, the concentration of the phosphorus component contained in the electroless nickel-phosphorus plated coating 23 in Comparative Example 1, and the thickness t of the electroless nickel-phosphorus plated coating 23 in Comparative Examples 2 and 3 were changed from those of the embodiment. In Comparative Examples 4 and 5, the test was conducted on specimens to which the molten tin plated coating 11 was applied as in the conventional ice compartment 10 described with reference to FIG. 12. Various conditions for each of the Experimental Examples and Comparative Examples are as described in Table 1. A test A to be described later was conducted with respect to Experimental Example 1, Experimental Example 2, Comparative Example 1, Comparative Example 2 and Comparative Example 3, a test B to be described later was conducted with respect to Experimental Example 3, Experimental Example 4, and Comparative Example 4, and a test C to be described later was conducted with respect, to Experimental Example 5, Experimental Example 6 and Comparative Example 5.

In the test A, a 5% sodium chloride (NaCl) aqueous solution and 0.5% hydrogen chloride (HCl) aqueous solution were mixed to prepare a test liquid, which was sprayed in a test chamber at 35° C., and the specimens were exposed to the test liquid over 168 hours. In the test B, the specimens were dipped in a 10 ppm sodium hypochlorite (NaClO) aqueous solution over 1500 hours. In the test C, the specimens were exposed to an atmosphere of a 5 ppm hydrogen sulfide gas over 1500 hours. In the corrosion resistance confirmation test, whether corrosion on the specimens had occurred or not was observed mainly by visual observation. The Table 1 shows the results. In the test results in Table 1, the observation of the occurrence of corrosion was marked "×", and the observation of no occurrence of corrosion was marked "○".

TABLE 1

| | Type of coating | Thickness of coating (μm) | P concentration (%) | Test | Result |
|---|---|---|---|---|---|
| Experimental Example 1 | electroless Ni—P plating | 27.0 | 10-15 | A | ○ |

TABLE 1-continued

| | Type of coating | Thickness of coating (μm) | P concentration (%) | Test | Result |
|---|---|---|---|---|---|
| Experimental Example 2 | electroless Ni—P plating | 27.1 | 10-15 | A | ○ |
| Comparative Example 1 | electroless Ni—P plating | 20.3 | 8 | A | × |
| Comparative Example 2 | electroless Ni—P plating | 10.4 | 10-15 | A | × |
| Comparative Example 3 | electroless Ni—P plating | 10.8 | 10-15 | A | × |
| Experimental Example 3 | electroless Ni—P plating | 15.2 | 10-15 | B | ○ |
| Experimental Example 4 | electroless Ni—P plating | 21.0 | 10-15 | B | ○ |
| Comparative Example 4 | molten Sn plating | 21.8 | — | B | × |
| Experimental Example 5 | electroless Ni—P plating | 15.1 | 10-15 | C | ○ |
| Experimental Example 6 | electroless Ni—P plating | 21.5 | 10-15 | C | ○ |
| Comparative Example 5 | molten Sn plating | 21.3 | — | C | × |

In the test A, corrosion was observed in Comparative Examples 2 and 3 where the thickness t of the electroless nickel-phosphorus plated coating 23 was respectively set to 10.4 μm and 10.8 μm. However, corrosion was not observed in Experimental Examples 1 and 2 where the thickness t of the electroless nickel-phosphorus plated coating 23 was set to 27.0 μm and 27.1 μm, respectively. The results seem to have been derived from the oxidation of the basis material 17 exposed through the pinholes in the coating 23 in Comparative Examples 1 and 2 where the thickness t of the coating 23 was thinner than those of Experimental Examples 1 and 2, whereas pinholes which reach the basis material 17 did not exist in Experimental Examples 1 and 2 where the coating 23 was made thicker. In the test B and test C, corrosion was not observed in Experimental Examples 3, 4, 5 and 6 where the thickness t of the electroless nickel-phosphorus plated coating 23 was respectively set to 15.2 μm, 21.0 μm, 15.1 μm and 21.5 μm. It was confirmed through the observation that setting the thickness t of the coating 23 to 15 μm or more could provide sufficient corrosion resistance.

In Comparative Example 1 where the content of the phosphorus component in the electroless nickel-phosphorus plated coating 23 was 8% (what is called an intermediate-phosphorus type), with the thickness t of 15 μm or more, corrosion on the coating 23 was observed. In Experimental Examples 1 to 6 where the content of the phosphorus component in the electroless nickel-phosphorus plated coating 23 was 10% to 15% (what is called a high-phosphorus type), by way of contrast, corrosion in the coating 23 was not observed. Therefore, it can be confirmed that setting the content of the phosphorus component in the electroless nickel-phosphorus plated coating 23 to 10% to 15% can provide sufficient corrosion resistance.

In both of Comparative Examples 4 and 5 where the thickness of the molten tin plated coating 11 was respectively set to 21.8 μm and 21.3 μm, corrosion on the coating 11 was observed. In both of Experimental Examples 3 and 5 where the thickness t of the electroless nickel-phosphorus plated coating 23 was respectively set to 15.2 μm and 15.1 μm, by way of contrast, corrosion on the coating 23 was not observed. It can be confirmed through the observation that the electroless nickel-phosphorus plated coating 23 provides high corrosion resistance as compared with the molten tin plated coating 11.

Modifications

The present invention is not limited to the embodiment described with reference to FIGS. 1A to 1C, and may be modified as follows, for example.

(1) The layer structure between the basis material and the electroless nickel-phosphorus plated coating is not limited to that of the embodiment. That is, a base layer and an adjustment layer which are different from those of the embodiment may be provided, or another layer may be provided.

(2) The ice-making unit is not limited to the ice compartment to be used in the injection type automatic ice maker or the ice-making plate to be used in the flow-down type automatic ice maker, and may be a freezing casing or the like, for example, which is used in an auger type automatic ice maker, has a cooling pipe wound around the outer peripheral surface of the casing, and produces ice on the inner peripheral surface thereof. Further, the structure of the ice compartment, as the ice-making unit is not limited to that of the embodiment. For example, the ice compartment may be of a type where a frame having small ice compartments formed therein is provided on the bottom of an ice-making board on which a cooling pipe is disposed in a meandering fashion. Furthermore, the automatic ice maker is not limited to the independent type as in the embodiment, and may be incorporated in a refrigerator or a freezer. That is, the automatic ice maker according to the present invention may be the one provided in the ice-making space defined in the freezing compartment of a household refrigerator, in which case the ice-making unit may be an ice-making tray or the like which is disposed in the ice-making space and is cooled by an evaporator connected to the refrigeration system.

(3) The electroless nickel-phosphorus plated coating should be formed at least on that region of the outermost layer of the ice-making unit on which ice is produced.

Figure 11:
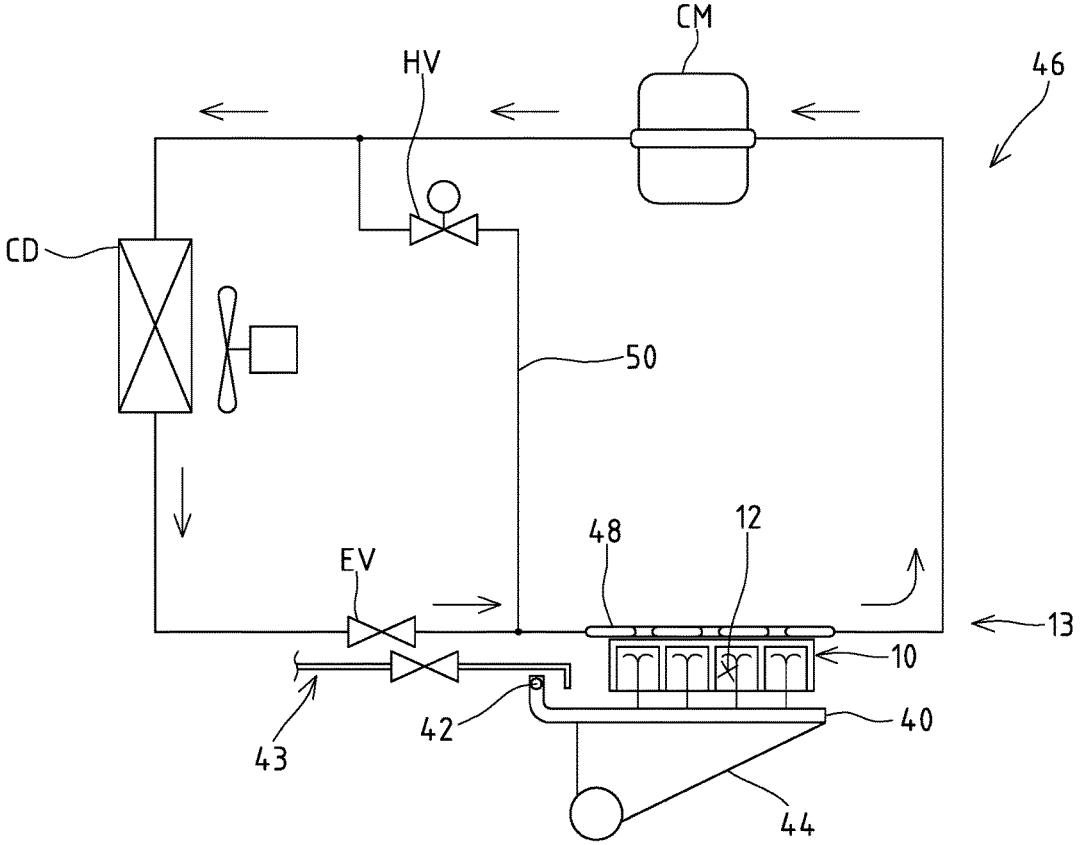
FIG. 11 is a schematic configuration diagram of an injection type automatic ice maker.

Next, an injection type ice maker according to another aspect of the present invention is described. The injection type ice maker according to another aspect is the closed-cell type ice maker which has been described with reference to FIG. 11. The structure of the ice compartment 10 to which this another aspect, is applied is as described with reference to FIG. 12. The partition member 30 has the plurality of small ice compartments 12 defied by combining a plurality of horizontal partition plates 30*a* and a plurality of vertical partition plates 30*b* to partition the interior in a lattice shape, as shown in, for example, FIGS. 13 and 14. That is, slits 60 are formed at predetermined intervals in the lower end portions of the horizontal partition plates 30*a*, slits 62 are formed at predetermined intervals in the upper end portions of the vertical partition plates 30*b*, and the lattice-shaped partition member 30 shown in FIG. 13 is obtained by fitting the slits 60 of the horizontal partition plates 30*a* into the respective slits 62 of the corresponding vertical partition plates 30*b*. Those portions of the horizontal partition plate 30*a* and the vertical partition plate 30*b* which abut on the back surface of the top plate 16 of the outer frame 14 to be described later are formed straight, and unlike in the structure in FIG. 12, neither the horizontal partition plate 30*a* nor the vertical partition plate 30*b* has projections 31 for caulking. It is preferable that copper having an excellent heat conductivity be used for both of the outer frame 14 and lattice-shaped partition member 30. However, as long as the heat conductivity is good, another metal or alloy, material may be used. In addition, the parts such as the outer frame 14, the partition member 30 including the horizontal and vertical partition plates 30*a*, 30*b*, and the evaporator 48, and other parts like brackets for mounting a temperature sensor (not shown) should be subjected to degreasing cleaning to completely remove grease components prior to assembling those parts.

The ice compartment 10 is obtained by disposing the lattice-shaped partition member 30 inside the box-shaped outer frame 14 and joining both components together. The outer frame 14 and the partition member 30 are joined together by what is called brazing. Examples of the means for joining two metals together include "soldering" in which a "solder" of an alloy essentially consisting of tin and lead is used as a bonding agent, and "brazing" in which "brazing materials" of various alloys having a lower melting point than the base material is used as a bonding agent. There is an interpretation such that "soldering" and "brazing" are kinds of welding from the academic point of view, and the use of a bonding agent (soft solder) having a melting point of 450° C. or lower is called "soldering", whereas the use of a bonding agent (hard solder) having a melting point of 450° C. or higher is called "brazing". In this another aspect, the use of a soft solder as well as the use of a hard solder shall be referred to as what is called "brazing".

Since there are a sheet type, a foil type, a linear type, and a paste type in addition to a rod type for the "solder" and "brazing material", an appropriate type should be selected in use as needed. In the joining process, for example, after a rod-type brazing material (not shown) is placed on the upper surfaces of the vertical partition plates 30*b*, the box-shaped outer frame 14 is placed thereover from above to interpose the rod-type brazing material in close contact between the back surface of the top plate 16 of the outer frame 14 and the vertical partition plates 30*b*. Then, the ice compartment 10 including the outer frame 14 and the partition member 30 is placed in a heating furnace heated to a predetermined temperature range, and furnace brazing is performed for a predetermined time. The furnace heating performed in the heating furnace in this way heats the whole members, so that thermal distortion does not occur. Accordingly, a correction work for eliminating thermal distortion is no longer required.

A paste-type brazing material may be used instead of the paste-type brazing material described above, and may be applied to the back surface of the top plate 16 before the partition member 30 is disposed. In this case, the paste-type brazing material may be applied to the entire back surface of the top plate. 16 or only to those portions of the partition member 30 where the horizontal and vertical partition plates 30*a*, 30*b* abut on, thereby saving the amount of the brazing material used. Further, at the time of the furnace brazing described above, the evaporator 48 may be mounted on the top plate 16, or parts like the brackets for mounting a temperature sensor, which needs brazing, may be supplemented, and such brazing in the heating furnace may be simultaneously carried out. It should be noted that if copper is selected as the material for the outer frame 14 and the partition member 30, the interior of the furnace is exposed to a high temperature in the brazing where a hard solder is used, so that the copper is undesirably annealed to lower the hardness. When copper is brazed, therefore, it is preferable to perform brazing at as tow brazing temperature as possible. For example, a brazing material whose melting point is lowered by a ternary eutectic crystal of copper, phosphorus and silver (eutectic mixture), or a quaternary eutectic crystal of copper, nickel, phosphorus and tin is used. This lowers the highest temperature of the brazing temperature, and shortens the time for the high temperature exposure in the furnace, thus minimizing the softening of copper which is the material for the outer frame 14 and the partition member 30.

Further, a copper alloy which has heat resistance and does not impair the property of a good heat conductor may be used as the material for the outer frame 14 and partition member 30 to braze the entire circumference of the contacting portions between both members 14, 30. Here, the copper alloy having heat resistance is referred to an alloy in which a certain element has been added to the components so that at the time of furnace heating at a high temperature, the element is deposited to provide the property of preventing the softening of the copper alloy A residual flux generated during brazing is adhered to the surface of the ice compartment 10 obtained by joining the outer frame 14 and the partition member 30 together. In the case of soldering with the soft solder, in particular, it is common to use a large amount of a flux to improve the joining property. Accordingly, the surface of the ice compartment 10 is cleaned by washing away the residue of the flux with a cleaning agent, water or the like, or physically scraping the residue by means of sand blasting or the like. In the case of brazing using the hard solder, however, the use of a reducing furnace that keeps the interior of the furnace in a reducing atmosphere as the heating furnace can eliminate the washing process. Here, the reducing furnace is the one that contains a hydrogen gas or converted gas in the furnace atmosphere, so that the brazing can be performed without using a flux, and the flux residue does not therefore occur.

Next, the electroless nickel-phosphorus plated coating 23 is applied to the surface of the ice compartment 10 (the entire inner and outer surfaces of the outer frame 14 and the partition member 30) which has undergone the surface cleaning treatment, as shown in FIGS. 1A to 1C. That is, the electroless nickel-phosphorus plated coating 23 is applied to the outermost layer of the ice compartment 10, in which case it is preferable to set the phosphorus concentration to 10% or more (high-phosphorus type), and set the thickness t to 15 μm or more. In other words, the electroless nickel-phosphorus plated coating 23 serves to enhance the corrosion resistance of the ice compartment 10, and is found to be desirably 15 μm or more in thickness as the results of the corrosion resistance confirmation test. When the coating 23 is less than 15 μm in thickness, pinholes reaching the basis material 17 may be produced, so that even the application of the electroless nickel-phosphorus plated coating 23 does not provide high corrosion resistance. Note that the corrosion resistance test was conducted on the basis of a corrosion accelerating test in which a 5% NaCl 0.5% HCl aqueous solution was used as the test liquid which was sprayed on the specimens at the test chamber temperature of 35° C., and the test liquid was exposed to a high temperature required for brazing.

The treatment of the electroless nickel-phosphorus plated coating 23 is carried out through what is called dipping by which the ice compartment 10 is entirely dipped in the reservoir of a nickel-phosphorus plating solution. At this time, as the base treatment of the electroless nickel-phosphorus plated coating 23 that serves as the outermost layer, two-layer treatment for plating nickel, palladium or the like on that surface of the ice compartment 10 which serves as the basis material 17, and then applying the electroless nickel-phosphorus plated coating 23 thereto may be performed. Further, three-layer treatment for plating copper on the surface of the ice compartment 10, then plating nickel thereon, and then applying the electroless nickel-phosphorus plated coating 23 to the nickel plating may be performed. In particular, soldering with the soft solder, like tin or lead, inhibits the deposition of the electroless plating in a post-processing (what is called "catalyst poison"), so that there is a great need for applying nickel plating or copper plating to the basis material 17 of the ice compartment 10 as done in the two-layer or three-layer treatment.

Meanwhile, the ice compartment 10 shown in FIG. 13 is configured in such a way that the partition member 30 having the horizontal and vertical partition plates 30*a*, 30*b* combined in a lattice shape is accommodated within the outer frame 14 including the rectangular top plate 16 and four side plates 18. However, as shown in FIGS. 2 and 8A to 8C of Japanese Unexamined Patent Publication No. Hei 7-260301, there is an ice compartment in which the outermost vertical and horizontal partition plates of a lattice-shaped partition member serve as the side plates of the ice compartment. In this case, a rectangular box-shaped ice compartment is configured merely by placing a top plate over the lattice-shaped partition member.

Thus, the lattice-shaped partition member 30 and the side plates 18 of the outer frame 14 in the ice compartment 10 may be separate bodies, or the outermost, horizontal and vertical partition plates 30*a*, 30*b* of the lattice-shaped partition member 30 may be treated as the side plates 18 of the outer frame 14. Further, the outer frame 14 of the ice compartment 10 may have the top plate 16 and the side plates 18 integrally formed, or may have the top plate 16 and the side plates 18 configured as separate bodies.

The above-mentioned another aspect described above provides the following advantageous effects.

As the surface treatment is performed on the ice compartment in such a way as to permit the actual amount of the electroless nickel-phosphorus plating to demonstrate a sufficient effect, the automatic ice maker can run without causing corrosion even under the environment where the conventional tin plating causes corrosion.

It is possible to perform a maintenance using chemicals such as disinfectants (sodium hypochlorite, electrolytic acid water, etc.) that cause corrosion or deterioration on the conventional tin plating and is thus difficult to use, so that the machine can be kept more hygienic.

Even a non-skilled worker can mass-produce ice compartments of stable quality by complying with the settings of a bonding-agent supply device, the heating furnace and the like.

Since all of the parts can be joined at a time, parts in progress are eliminated, which ensures efficient production to reduce the number of working processes.

In the case of brazing at a point, the local heating causes thermal distortion on the body of the ice compartment. However, the overall heating with the heating furnace eliminates thermal distortion. Therefore, distortion correction is no longer needed.

Since the entire contact surfaces between the inner surface of the outer frame and the partition member in the ice compartment are joined, the joint strength is improved, thereby contributing to an improvement in the durability of the surface treatment The projections for caulking of the partition member are made unnecessary, thus improving the yield of the materials.

The processing related to caulking (projections, caulking holes) are not required, thus leading to a shorter processing time.

In the case of soldering, the melting temperature of the solder is extremely lower than that, of the brazing material (for example, the brazing temperature of a phosphorus-copper solder is 650 to 900° C., whereas the soldering temperature is 200 to 300° C.), so that the soldering is advantageous with respect to a change such as enlargement of the organization coarsening of copper.

In the case of brazing, the material strength is greater than that of the soldering so that the joint strength is improved. In particular, the small ice compartments can have an anisotropy in strength due to combining the partition plates, but such an anisotropy is prevented by joining them all together with a brazing material.

In the case of brazing, a fluxless condition achieved by using the reducing furnace eliminates the need for the post-cleaning, so that the washing water, the chemicals and the labor can be reduced greatly, which leads to cost reduction.

In the case of brazing, the fluxless joining eliminates the risk of improper surface treatment (repelling plating, adhesion failure) caused by the flux residue still remaining after washing, thus stabilizing the quality.

In the case of using copper having heat resistance, the strength of the material is not reduced even brazing is carried out at a high temperature, so that the strength of the ice compartment can be maintained even when an inexpensive brazing material with a high brazing temperature is used. The use of the inexpensive brazing material can ensure a low cost.

Since the structure of the ice compartment that is used in the automatic ice maker according to the present invention has a disadvantage that the corner portion of the outer frame may be disjoined, some means for solving this disadvantage is described below After the drawbacks of the related art are discussed, the structure of the ice compartment that solves the drawbacks is described.

Figure 9A:
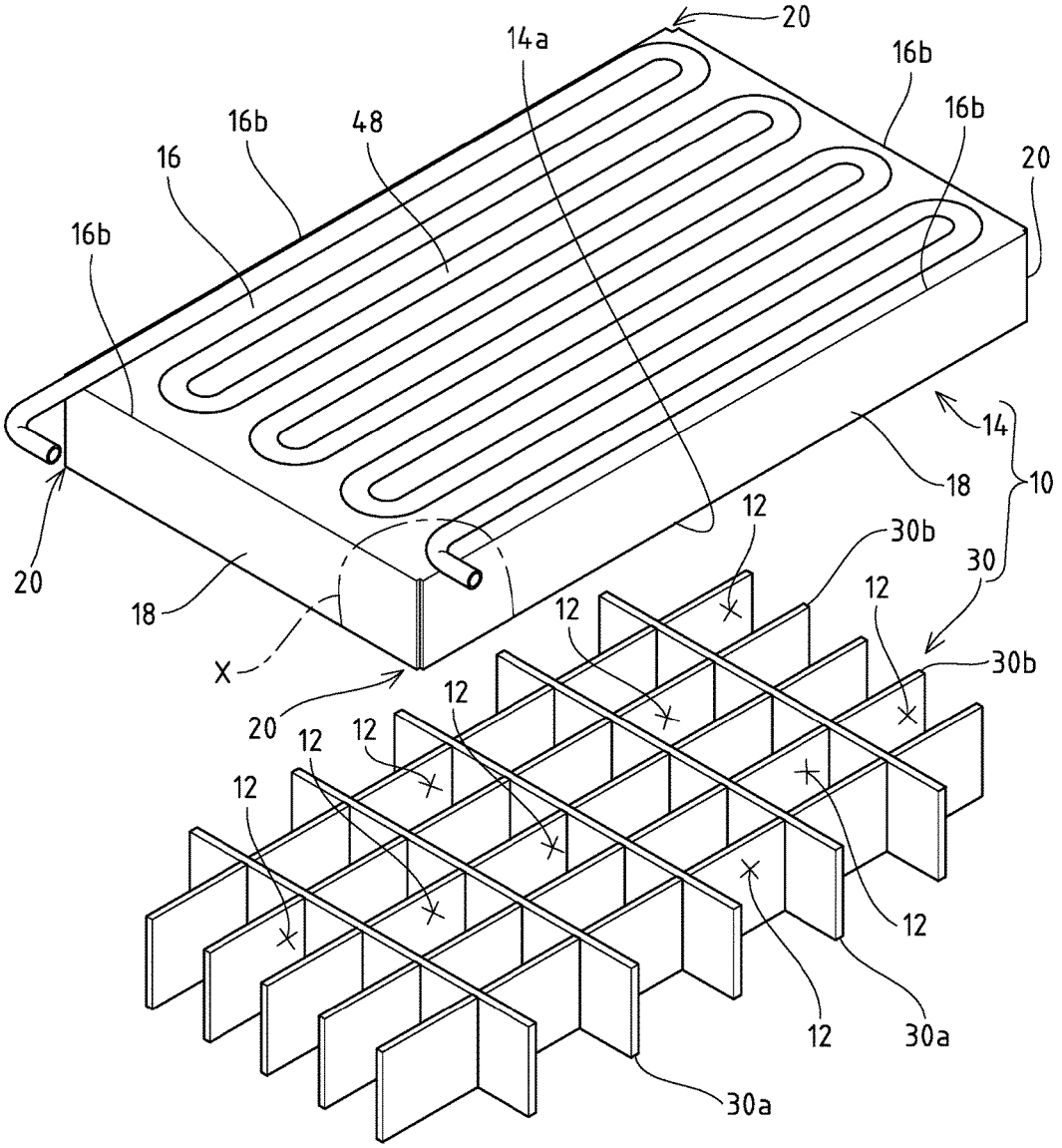
FIG. 9A is an exploded perspective view of an ice compartment according to the related art.
Figure 12:
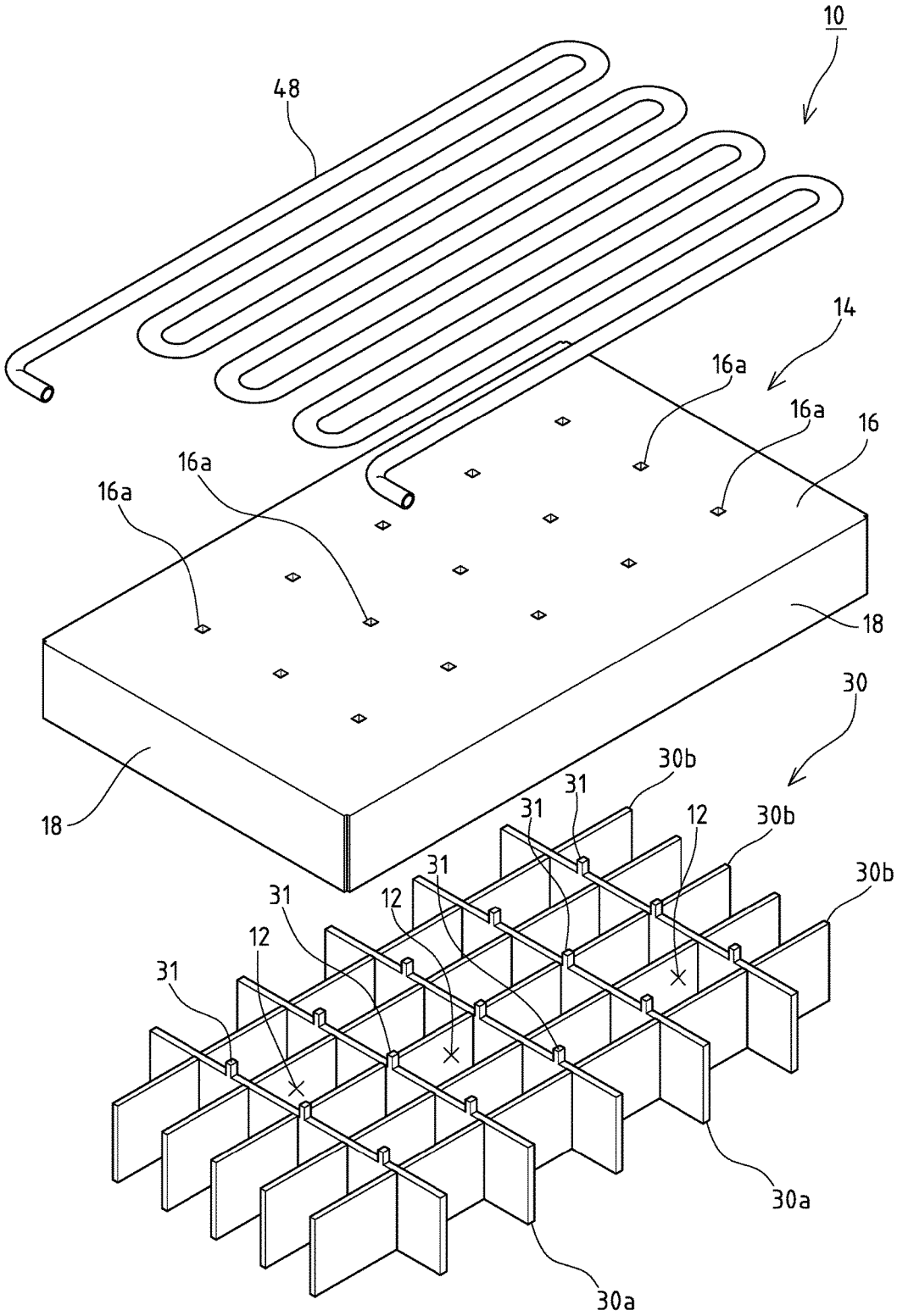
FIG. 12 is an exploded perspective view of an ice compartment according to the related art.
Figure 13:
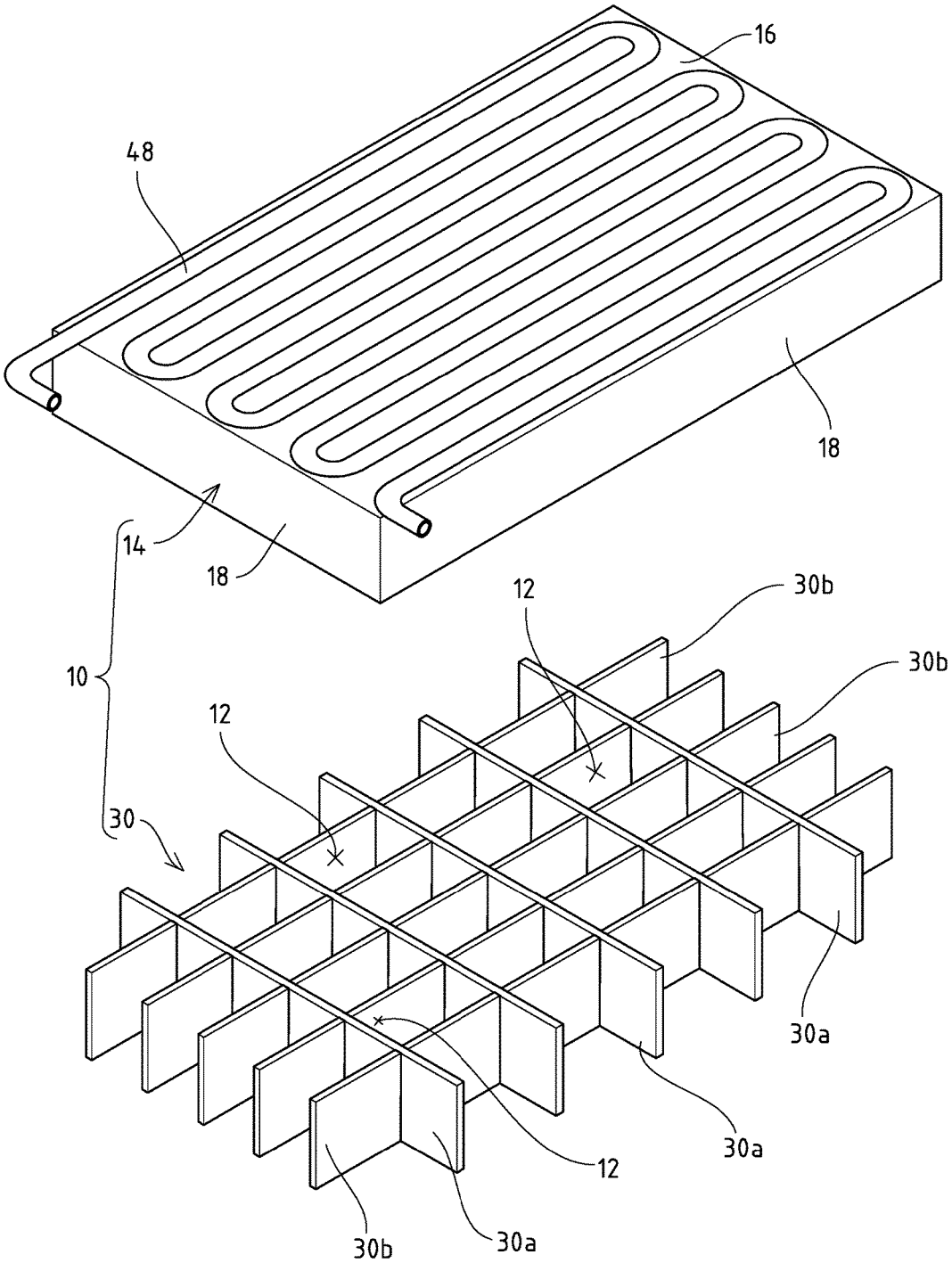
FIG. 13 is a perspective view of another embodiment of the ice compartment shown in FIG. 12, in which the ice compartment is disassembled into an outer frame on which an evaporator is disposed, and a lattice-shaped partition member.
Figure 14:
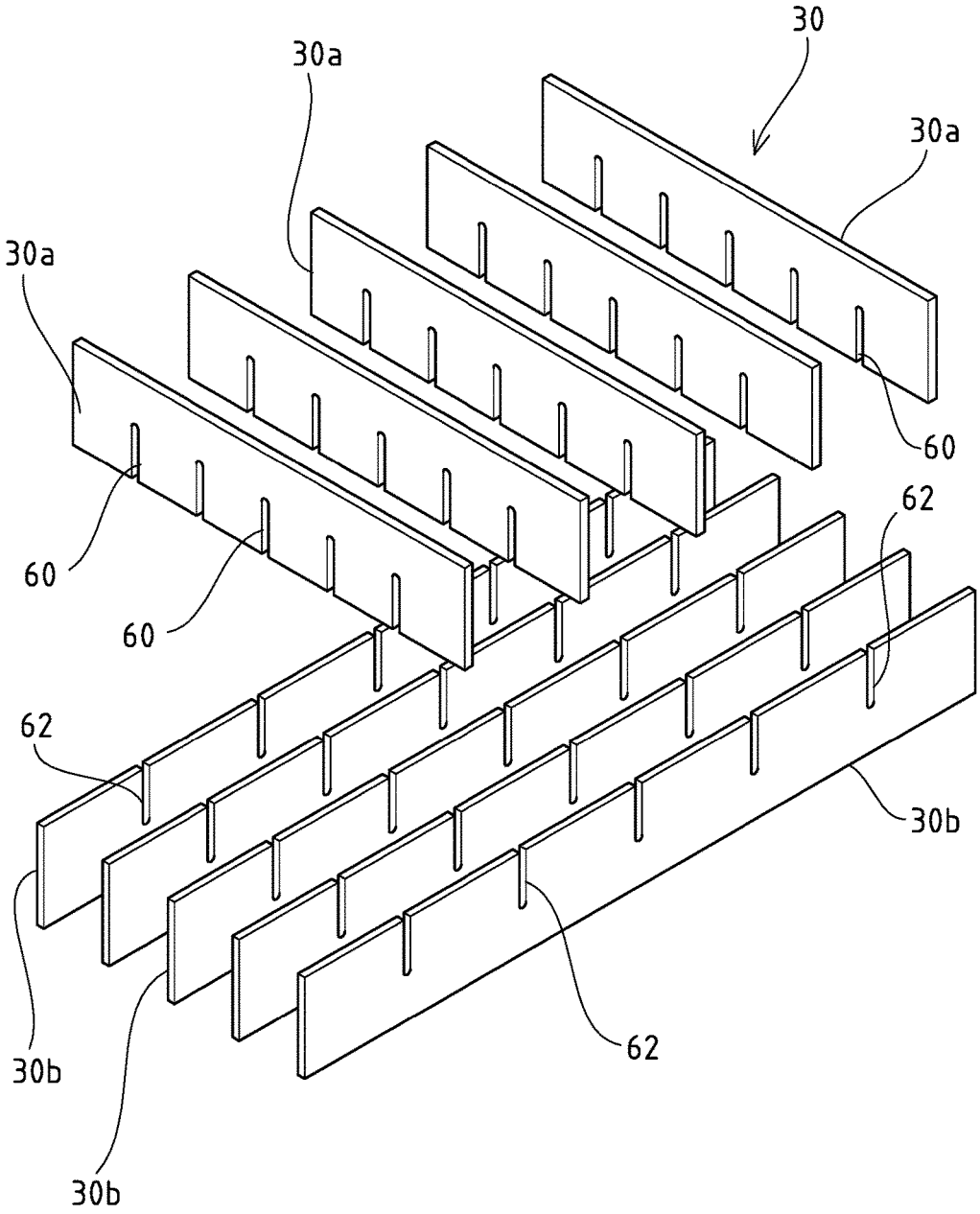
FIG. 14 is a perspective view of the partition member shown in FIG. 13 disassembled into vertical partition members and horizontal partition members.

FIG. 9A is an exploded perspective view of the ice compartment 10 described basically with reference to FIGS. 12 and 13. The outer frame 14 includes the rectangular top plate 16 where the cooling pipe 48 is disposed and the rectangular side plates 18 extending downward from the sides 16*b* of the top plate 16, and is formed by bending a metal plate of copper having an excellent heat conductivity That is, the outer frame 14, as shown in FIG. 10A, is formed as a rectangular box open downward by bending the side plates 18 integrally extending from four sides 16*b* of the top plate 16 along each side 16*b* of top plate 16, in the same direction indicated by an arrow fin FIG. 10B. Therefore, as shown in enlargement, in FIG. 9B, the side end portions of the two side plates 18, 18 which are made adjacent to each other by the bending form a corner portion 20 of the outer frame 14. The lattice-shaped partition member 30 shown in FIG. 9A is accommodated inside the outer frame 14 bent in this way through an opening 14*a* of the outer frame 14, and both members 14, 30 are joined by means of caulking, brazing or the like. In case of performing caulking, as illustrated in FIG. 12, the projections 31 are provided on the top of the partition member 30, and the caulking holes 16*a* are bored in the top plate 16, and the projections 31, which are inserted into the caulking holes 16*a* to project from the upper surface of the plate 10, are crushed with a hammer or the like.

Figure 9B:
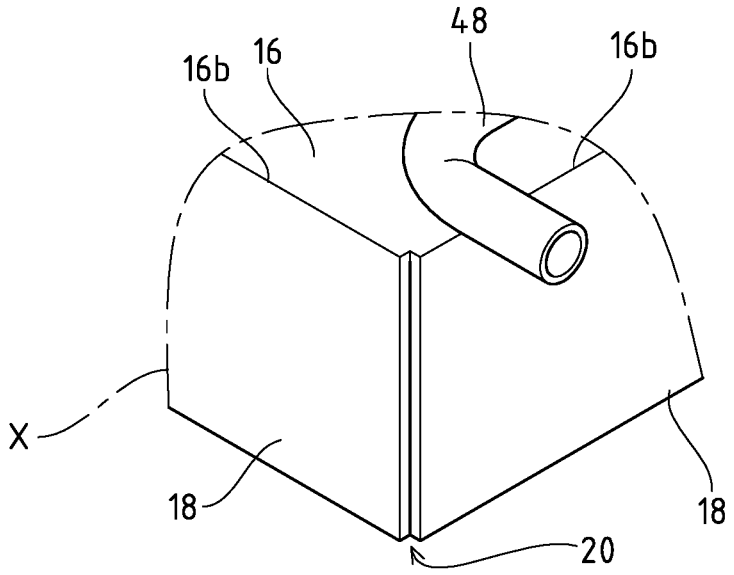
FIG. 9B is an enlarged view of a portion of the outer frame in FIG. 9A which is circled with X.
Figure 10A:
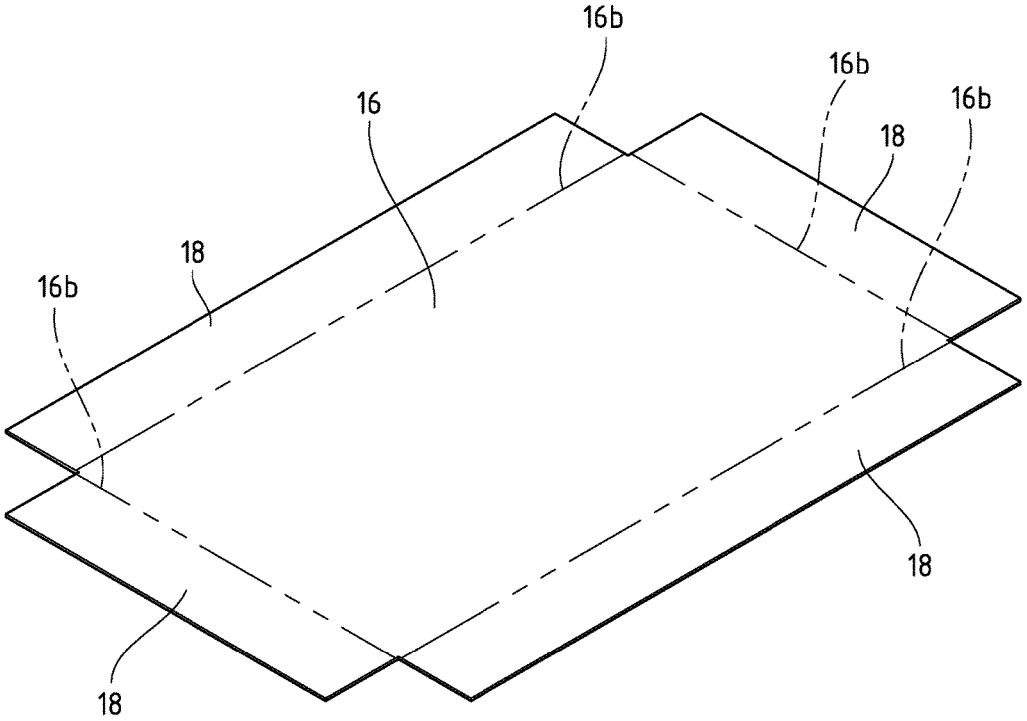
FIGS. 10A and 10B are explanatory perspective views of a step of forming the outer frame of the ice compartment shown in FIGS. 9A and 9B.
Figure 10B:
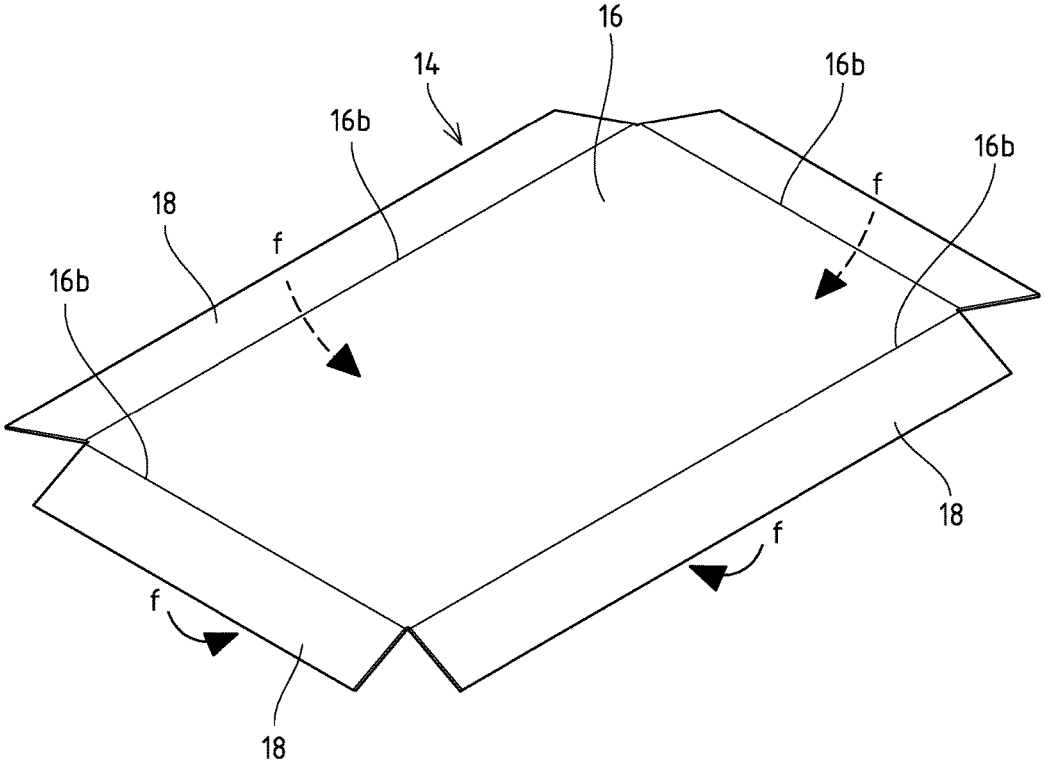

However, as shown in FIG. 9B, the side end portions of the two side plates 18, 18 are made adjacent to each other by the bending at the corner portion 20 of the outer frame 14 described in connection with FIG. 12. Then, the corner portion 20 is point-welded using a brazing material such as a phosphorus-copper solder to join both side end portions together. While this welding is carried out manually, the point welding to weld the end faces of both side plates 18, 18 requires a skilled technique, so that it is generally difficult to keep a constant quality. In addition, if the welding of the corner portion 20 is insufficient, the expansion force caused when ice grows in the small ice compartments 12 exerts strong stress on the side plates 18, so that the joint between the side plates 18 at the corner portion 20 may be disjoined to expand the opening 14*a* of the outer frame 14. Furthermore, at the time of brazing the corner portion 20, a flux is used to improve the wetting and spreading of the brazing material; however, it is necessary to clean or physically scrape off the flux residue remaining at the corner portion 20 after the joining process, thus increasing the number of processing steps. Accordingly, to solve this problem, an ice compartment 10 that structurally prevents the corner portion 20 of the outer frame 14 from being disjoined and has a stable quality is proposed as follows.

(Ice Making Compartment 10)

As shown in FIGS. 3A to 4B, the ice compartment 10, like the ice compartment 10 described with reference to FIGS. 9A to 10B, includes the box-shaped outer frame 14 which has the rectangular side plates 18 integrally extending from the respective four sides 16*b* of the rectangular top plate 16 and bent downward (in the same direction) along the respective sides 16*b* of the top plate 10 so that the outer frame 14 is open downward (toward one side), and the partition member 30 disposed inside the outer frame 14 to define a plurality of small ice compartments 12, and the cooling pipe 48 constituting the refrigeration system 46 is disposed on the upper surface of the outer frame 14 in close contact in a meandering fashion. That is, the outer frame 14, like the conventional outer frame 14, as shown in FIG. 4A, is formed from a metal plate having a shape obtained by cutting open the outer frame 14 at the corner portions 20 where the side plates 18 are joined to be developed on a plane, and is formed by bending the side plates 18 downward as indicated by an arrow a along the respective sides 16*b* of the top plate 16 shown by a two-dot chain line in FIG. 4A. Then, like the conventional outer frame 14, the lattice-shaped partition member 30 is disposed inside the bent outer frame 14.

(Outer Frame 14)

Figure 3A:
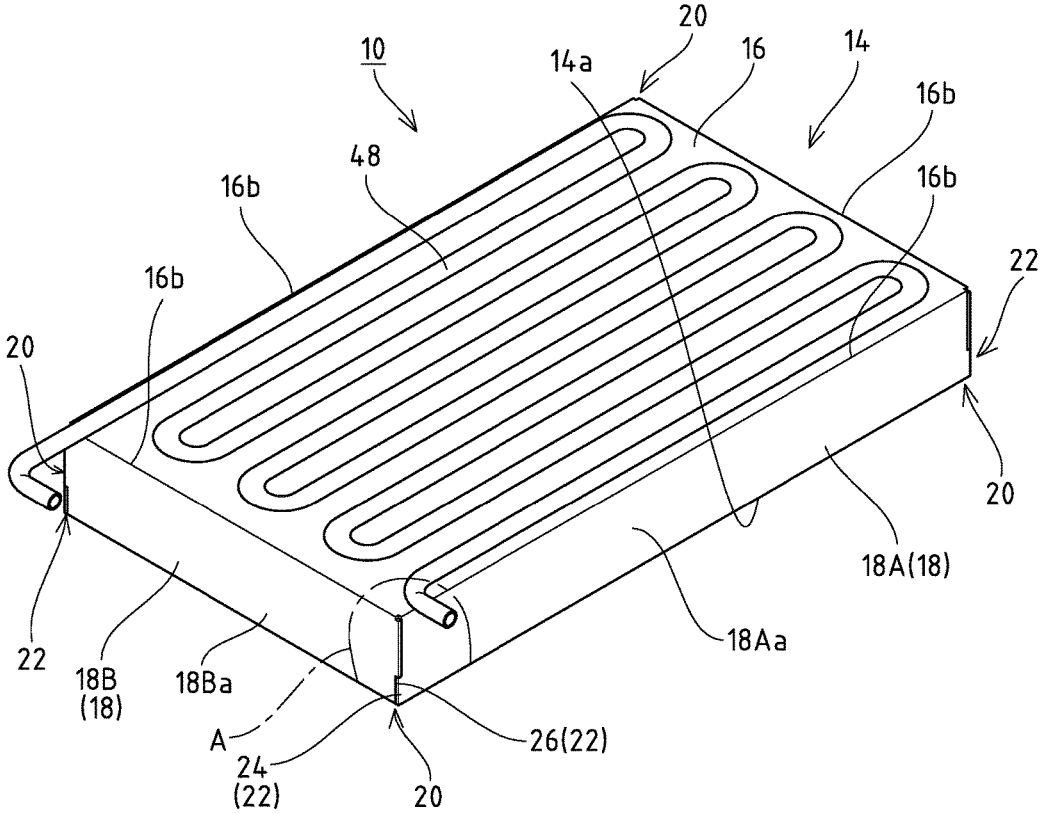
FIG. 3A is an overall perspective view of the ice compartment.

As shown in FIG. 3A, the side plates 18 include two long side plates 18, 18 (hereinafter sometimes referred to as first side plates 18A) facing and extending in parallel to each other and two short side plates 18, 18 (hereinafter sometimes referred to as second side plates 18B) facing and extending in parallel to each other, and the corner portion 20 of the outer frame 14 is formed by the side end portions of the first side plate 18A and the second side plate 18B perpendicular to each other. The sizes of the first side plate 18A and the second side plate 18B are set in accordance with the sizes and amount of ice blocks to be produced in the ice compartment 10, and both side plates 18A, 18B may have the same size. Further, the vertical sizes and thicknesses D1, D2 of the first side plate 18A and the second side plate 18B are set identical. Each of the partition plates 30*a*, 30*b* constituting the partition member 30 shown in FIG. 9A may be provided with engagement pieces at the side end portions, and engagement grooves to be engaged with the respective engagement pieces may be formed in the lower end portions of the side plates 18 at portions where the engagement grooves correspond to the engagement pieces.

(Fitting Portion 22)

As shown in FIG. 3A, fitting portions 22 which are fitted to each other by bending the side plates 18 with respect to the top plate 16 are provided on the side end portions of the two side plates 18, 18 of the outer frame 14 which are adjacent to each other to form the corner portion 20. That is, the fitting portion 22 is provided at each of the four corner portions 20 of the outer frame 14 formed by the side end portions of the first side plates 18 and the side end portions of the second side plates 18B. The fitting portion 22 includes an extending portion 24 formed on the side end portion (end portion) of the first side plate 18A (one side plate) facing the corner portion 20, and a notch portion 26 formed on the side end portion (end portion) of the second side plate 18B (the other side plate) facing the corner portion 20 to receive the extending portion 24 in a contact state.

(The Extending Portion 24)

Figure 3B:
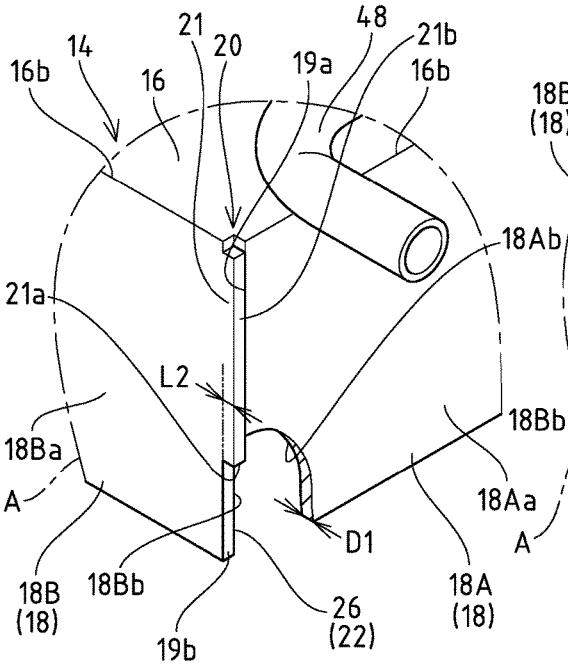
FIG. 3B is an enlarged view of a portion of a corner portion of an outer frame in FIG. 3A which is circled with A, with a portion of a first side plate being cut away to expose a notch portion.
Figure 3C:
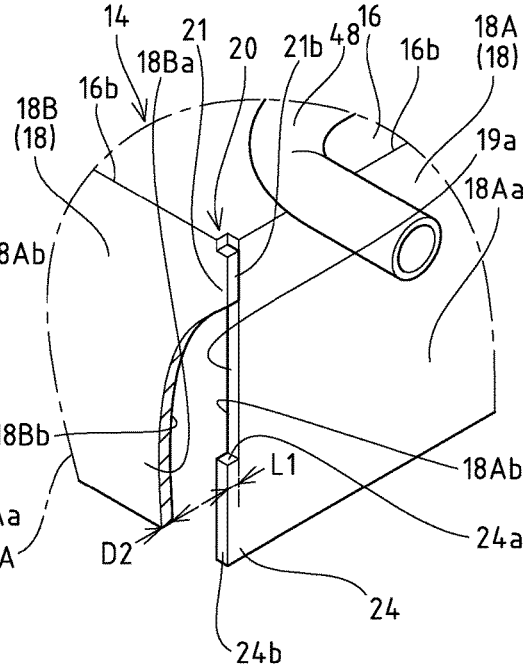
FIG. 3C is also an enlarged view of the corner portion circled with A, with a portion of a second side plate being cut away to expose an extending portion.
Figure 4A:
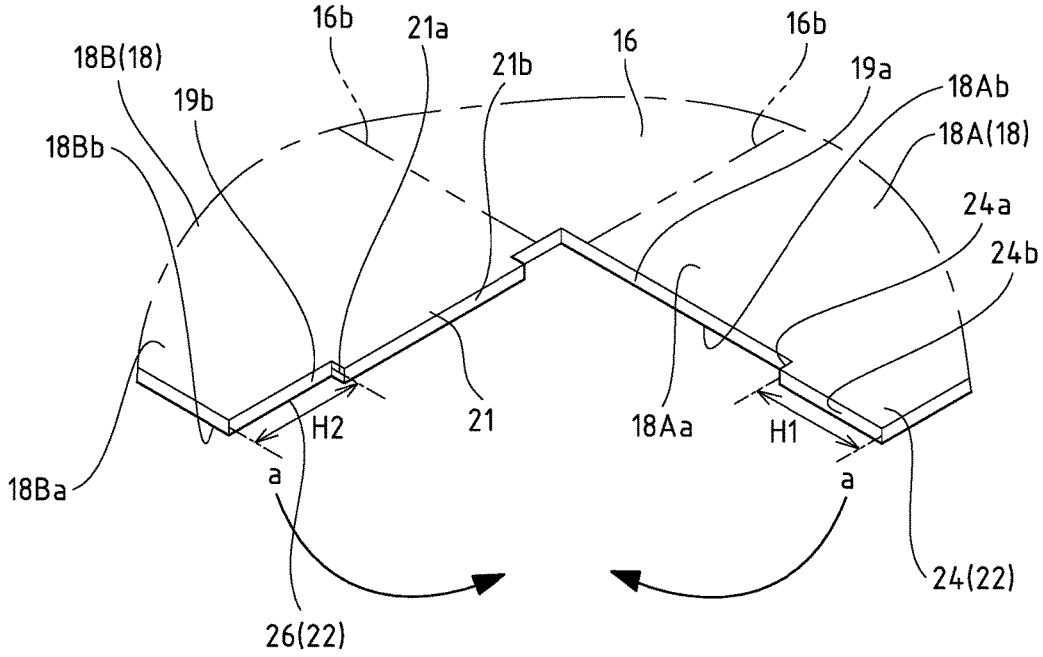
FIGS. 4A and 4B are explanatory views of a step of forming the outer frame shown in FIGS. 3A to 3C.
Figure 4B:
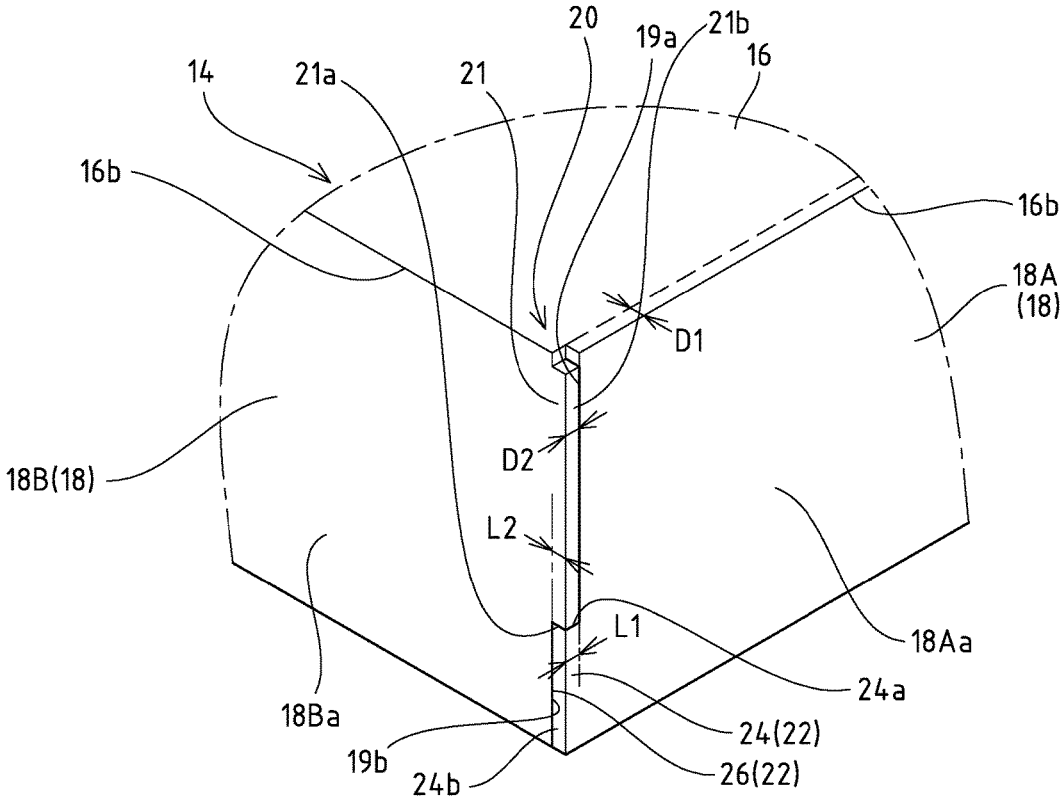

As shown in FIG. 3C, the extending portion 24 extending from a first side end face 19*a* of the first side plate 18A, which extends on the same plane as an inner surface 18Bb of the second side plate 18B, in the thicknesswise direction of the second side plate 18B is formed on the side end portion of the first side plate 18A. This extending portion 24 is provided at both lower corner portions of the first side plate 18A in such a way as to have the same thickness as the first side plate 18A and extended on the same plane as the surface of the first side plate 18A. Further, an extension length L1 of the extending portion 24 from the first side end face 19*a* is set identical to at least the thickness D2 of the second side plate 18B. The extension length L1 of the extending portion 24 shown in FIGS. 3A to 4B is set identical to the thickness D2 of the second side plate 18B, and as shown in FIG. 4B, an extending end face 24*b* of the extending portion 24 and an outer surface 18Ba of the second side plate 18B are set to be aligned with each other. In addition, the extending portion 24 is formed so that the strength thereof is increased by increasing its height H1 (FIG. 4A).

(Notch Portion 26)

As shown in FIG. 3B a projection 21 projecting from a second side end face 19*b* of the second side plate 18B, which extends on the same plane as an inner surface 18Ab of the first side plate 18A, in the thicknesswise direction of the first side plate 18A is formed on the side end portion of the second side plate 18B. This projection 21 is provided at a position shifted upward from the lower end of the second side plate 18B in correspondence to the extending portion 24 of the first side plate 18A, and the notch portion 26 is formed so as to be defined by a bottom surface 21*a* of the projection 21 and the second side end face 19*b* to open downward and sideward and receive the extending portion 24 in a contact state. This notch portion 26 is provided at both lower corner portions of the second side plate 18B in association with the extending portion 24. Further, an extension length L2 of the projection 21 from the second side end face 19*b* is set identical to the thickness D1 of the first side plate 18A, and as shown in FIG. 4B, a projection end face 21*b* of the projection 21 and the outer surface of the extending portion 24 (outer surface 18Aa of the first side plate 18A) which is fitted in the notch portion 26 are set to be aligned with each other. In addition, a vertical height (length) dimension H2 of the notch portion 26 of the second side plate 18B is set slightly greater than the vertical height (length) dimension H1 of the extending portion 24 of the first side plate 18A, and as will be described later, the extending portion 24 is received in the notch portion 26 in a contact state.

(Fitting State)

As shown in FIGS. 4A and 4B, the fitting portion 22 is formed in the forming process of the outer frame 14 in such a way that when the side plates 18 are bent, along the individual sides 16*b* of the top plate 16, the extending portion 24 is received in the notch portion 26 in a contact state. In the fitting state where the extending portion 24 is received in the notch portion 26, as shown in FIG. 4B, the upper surface 24*a* of the extending portion 24 and the lower surface 21*a* of the projection 21 which forms the notch portion 26 abut in close contact on each other, and the inner surface of the extending portion 24 and the second side end face 19*b* which forms the notch portion 26 abut in close contact on each other, so that the first side plate 18A and the second side plate 18B are structurally fixed together. The fitting strength of the fitting portion 22 is set in such a way that even when the expansion force or the like of the ice blocks that grow in the small ice compartment 12 acts outwardly on the side plates 18, the frictional force of the abutment surface between the extending portion 24 and the notch portion 26 prevents the joint between the first side plate 18A and the second side plate 18B from being disjoined. Note that increasing the height H1 of the extending portion 24 and the height H2 of the notch portion 26 increases the area of adhesion (the degree of adhesion) between the extending portion 24 and the notch portion 26, thereby enhancing the strength of the joint between both side plates 18A, 18B.

In the fitting state of the fitting portion 22, the inner surface of the projection 21 of the second side plate 18B abuts on the first side end face 19*a* of the first side plate 18A. Further, in the fitting state, the inner surface of the extending portion 24 of the first side plate 18A abuts on the second side end face 19*b* of the second side plate 18B as described above. That is, the first side plate 18A and the second side plate 18B abut on the side end faces 19*a*, 19*b* of the other side plate 18 to restrict such deformation as to be inclined inward relative to the top plate 16. Thus, the first side plate 18A and the second side plate 18B have such a relationship as to receive each other. As shown in FIG. 4A, the side plates 18 when bent with respect to the top plate 16 are bent along each side 16*b* of the top plate 16 shown by the two-dot chain line in the direction of the arrow a. The first side plate 18A and the second side plate 18B, when bent to predetermined positions substantially perpendicular to the top plate 16 shown in FIG. 4B, abut on the other side plates 18 in the opposite direction to the bending movement direction. That is, the first side plate 18A and the second side plate 18B are formed so as to mutually receive each other's forces of the bending movement directions.

Next, the operation of the ice compartment 10 shown in FIGS. 3A to 4B is described. The ice compartment 10 is configured in such a way that bending the side plates 18 with respect to the top plate 16 causes the notch portion 26 of the second side plate 18B facing the corner portion 20 to receive the extending portion 24 of the first side plate 18A facing the same corner portion 20 so that the notch portion 26 and the extending portion 24 are fitted to each other, structurally fixing together the first side plate 18A and the second side plate 18B. Then, the corner portion 20 of the first side plate 18A and the second side plate 18B are joined by furnace brazing. That is, the worker does not need to perform point welding manually, making it possible to reduce the number of the working processes. In addition, unlike point welding using a brazing material, which requires a skilled technique, or the like, variations in the quality of the product, that are originated from the skills of workers are not likely to occur in the bending of the metal plate, so that the quality of the ice compartment 10 can be-stabilized. Further, it is possible to keep an appropriate clearance between both side plates 18A, 18B at the time of furnace-brazing the corner portion 20 of both side plates 18A, 18B. Further, the structural fixation of the first side plate 18A and the second side plate 18B enhances the strength of the joint between the corner portion 20 of the outer frame 14, making it possible to effectively prevent the corner portions 20 from being disjoined by the expansion force of ice growing in the ice compartment 10.

The extending portion 24 of the first side plate 18A in the ice compartment 10 abuts on the second side end face 19*b* of the second side plate 18B, and the projection 21 of the second side plate 18B abuts on the first side end face 19*a* of the first side plate 18A. As the first side plate 18A and the second side plate 18B abut on the other side plates 18 to receive each other, such deformation as to cause the side plates 18 to incline inward with respect to the top plate 16 can be structurally restricted. When the side plates 18 are inclined inward in the manufacturing process of the ice compartment 10, the inner space of the outer frame 14 where the partition member 30 is disposed becomes smaller, thereby undesirably making impossible to dispose the partition member 30 or deforming the partition member 30 disposed within the outer frame 14. It should be noted that when the partition member 30 is deformed, the shapes of ice cubes to be produced may be, distorted or an extra load is constantly applied to the outer frame 14. Since the outer frame 14 can keep a constant distance between the opposing side plates 18, 18, the partition member 30 can be disposed with an appropriate clearance.

The outer frame 14 having the individual side plates 18 whose upper end portions are integral with the top plate 16 is configured so that the lower sides (open end sides) of the corner portions 20 are easily disjoined. Since the extending portion 24 and the notch portion 26 of the outer frame 14 shown in FIGS. 4A and 4B are provided at the lower corner portions of the side plates 18, the fitting portion 22 can effectively prevent, the lower sides of the corner portions 20 from being disjoined. Note that increasing the height H1 of the extending portion 24 and the height H2 of the notch portion 26 increases the strength of the extending portion 24 itself to which force is easily applied and the area of adhesion between the extending portion 24 and the notch portion 26, so that the strength of the joint between the side end portion of the first side plate 18A and the side end portion of the second side plate 18B is enhanced. That is, increasing the ratio of the height of the fitting portion 22 to the height of the outer frame 14 can enhance the structural joint strength of the corner portions 20 of the outer frame 14, thus effectively preventing the opening 14*a* of the outer frame from being expanded.

Next, the ice compartment 10 shown in FIGS. 4A and 4B is configured in such a way that the extending end faces 24*b* of the extending portions 24 provided on the side end portions of the first side plates 18A are aligned with the outer surfaces 18Ba of the second side plates 18B. In the configuration shown in FIGS. 5 to 6B, by way of contrast, the extending portion 24 is formed so as to extend more than the thickness D2 of the second side plate 18B (the other side plate), and after the side plates 18 are bent with respect to the top plate 16, the extending portion 24 is bent to abut on the second side plate 18B. Note that the same members in the ice compartment 10 shown in FIGS. 5 to 6B as those in the configuration shown in FIG. 3A to 4B are denoted by same reference numerals.

Figure 5:
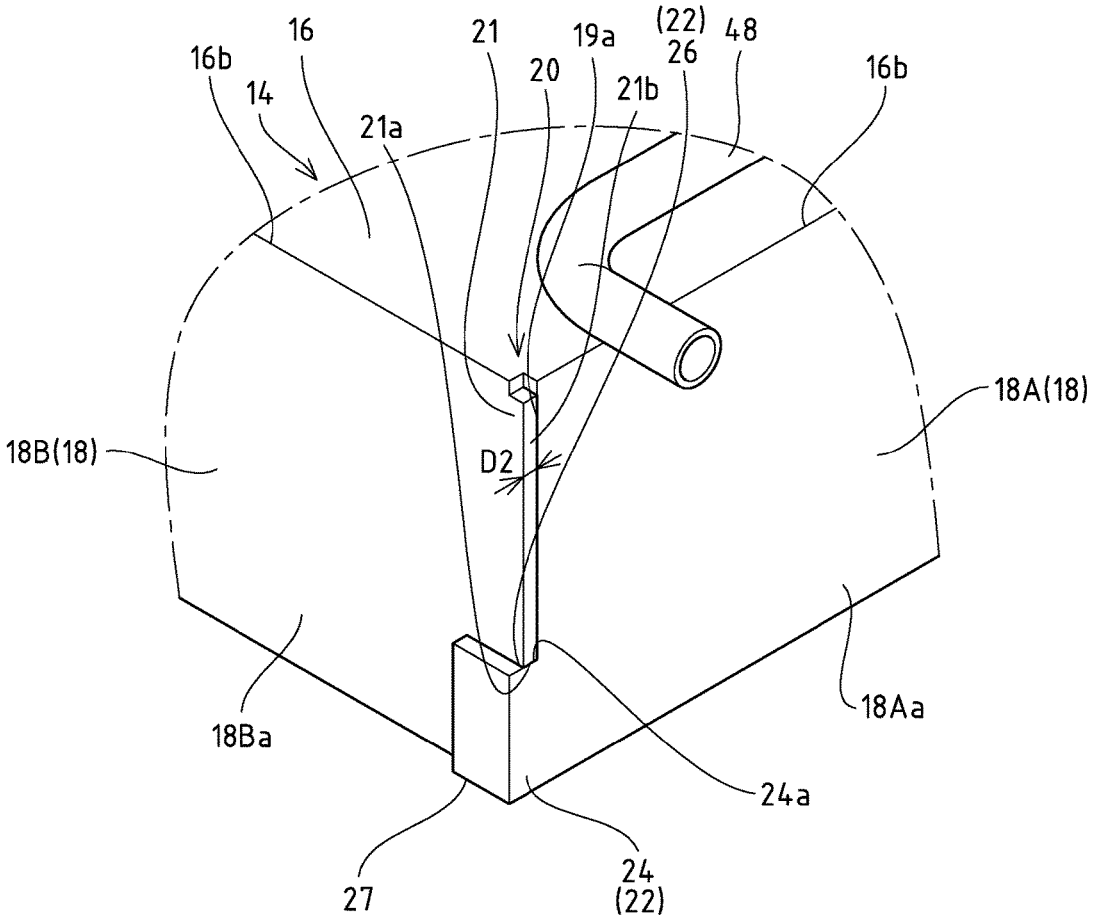
FIG. 5 is an enlarged perspective view of a corner portion of an outer frame according to another embodiment.

As shown in FIG. 5, the extending portion 24 extends along the surface of the first side plate 18A to be fitted in the notch portion 26, and an extending end portion 27 of the extending portion 24 is bent so as to extend along the surface of the second side plate 18B. That is, the extending end portion 27 of the extending portion 24 shown in FIG. 5 is a bent portion 27 that is bent perpendicularly toward the second side plate 18B with respect to the surface of the first side plate 18A so that the inner surface of the extending end portion 27 abuts on the outer surface 18Ba of the second side plate 18B.

Figure 6A:
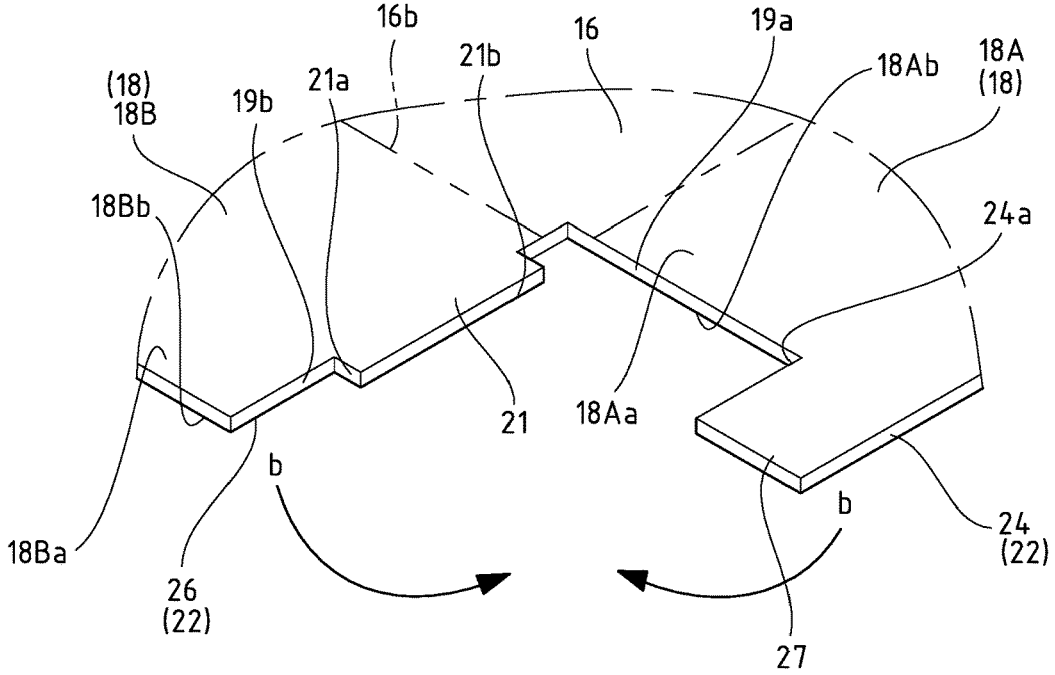
FIGS. 6A and 6B are explanatory views of a step of forming the outer frame shown in FIG. 5.
Figure 6B:
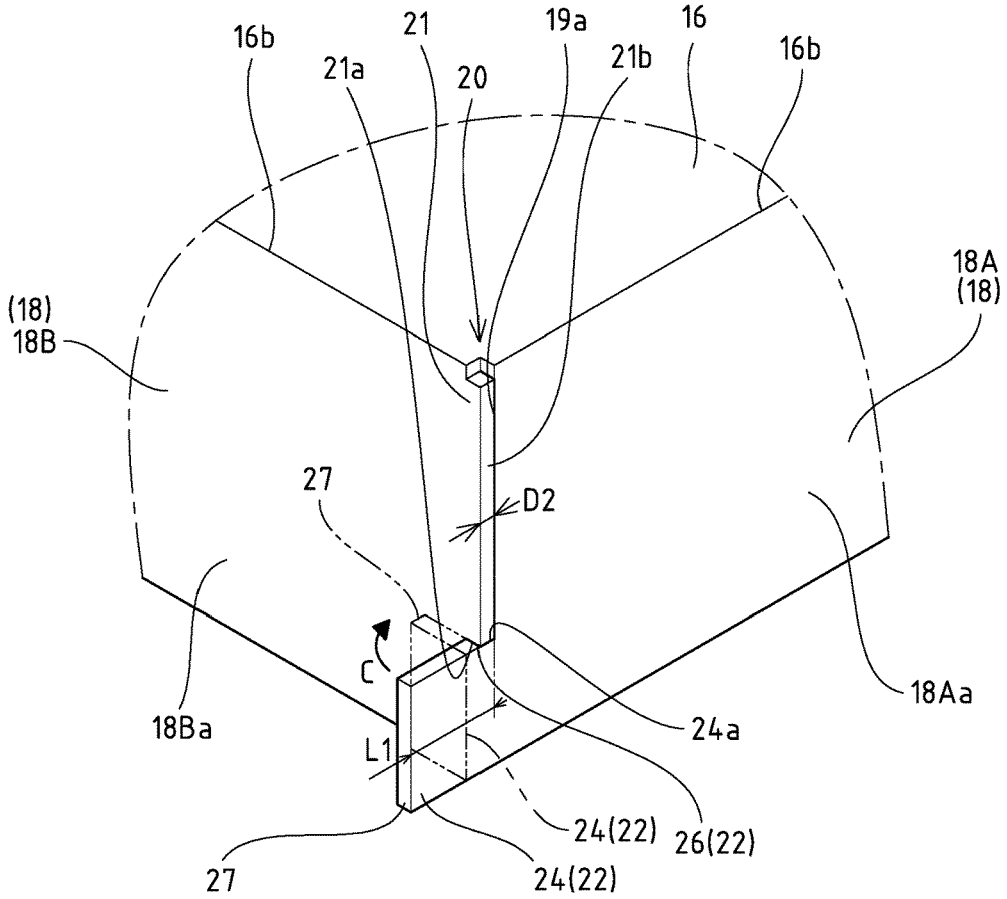

Next, the forming of the outer frame 14 is described with reference to FIGS. 6A and 6B. As shown in FIG. 6A, in the state before bending the side plate 18 with respect to the top plate 16, the extending end portion 27 of the extending portion 24 is extended on the same plane as the surface of the first side plate 18A in such a way that the extension length L1 of the extending portion 24 from the first side end face 19*a* is greater than the thickness D2 of the second side plate 18B. As shown in FIG. 6B, the outer frame 14, like the outer frame 14 shown in FIGS. 3A to 4B, is configured so that when the side plates 18 are bent along the respective sides 16*b* of the top plate 16, the extending portion 24 formed on the side end portion of the first side plate 18A is received in a contact state in the notch portion 26 formed in the side end portion of the second side plate 18B. With the extending portions 24 being received and fitted in the notch portion 26, the extending portion 24 extends outward farther than the outer surface 18Ba of the second side plate 18B. Then, as the extending end portion 27 of the extending portion 24 is bent at an angle of 90° toward the second side plate 18B as indicated by an arrow c in FIG. 6B by a corner forming machine or the like so that the inner surface of the extending end portion 27 approaches the outer surface 18Ba of the second side plate 18B, the bent portion 27 that extends along the outer surface 18Ba of the second side plate 18B is formed as represented by a two-dot chain line h FIG. 6B.

In the configuration shown in FIGS. 5 to 6B, since the extending portion 24 is bent along the outer surface 18Ba of the second side plate 18B in a hook shape, the fitting of the extending portion 24 into the notch portion 26 becomes stronger. That is, since the structural joint strength of the corner portion 20 of the outer frame 14 is increased, it is possible to effectively prevent the corner portion 20 of the outer frame 14 from being disjoined. Further, since the joint strength of the corner portion 20 of the outer frame 14 is enhanced by the work of extending the extending portion 24 and bending the extended extending end portion 27 by means of the corner forming machine or the like, which does not require a skill, the effects of stabilizing the quality and lowering the manufacturing cost can be expected.

Further, the ice compartment 10 described with reference to FIGS. 5 to 6B is configured so that the extending portion 24 provided on the first side plate 18A is bent along the outer surface 18Ba of the second side plate 18B. In the configuration shown in FIGS. 7A to 8C, by way of contrast, the extending portion 24 extends more than the thickness D2 of the second side plate 18B (the other side plate), and the extending portion 24 is pressed to abut on the second side plate 18B after the side plates 18 are bent with respect to the top plate 16. Note that same reference numerals are given to the same members in the ice compartment 10 shown in FIGS. 7A to 8C as those in the configuration shown in FIGS. 3A to 4B and those in the configuration shown in FIGS. 5 to 6B.

Figure 7A:
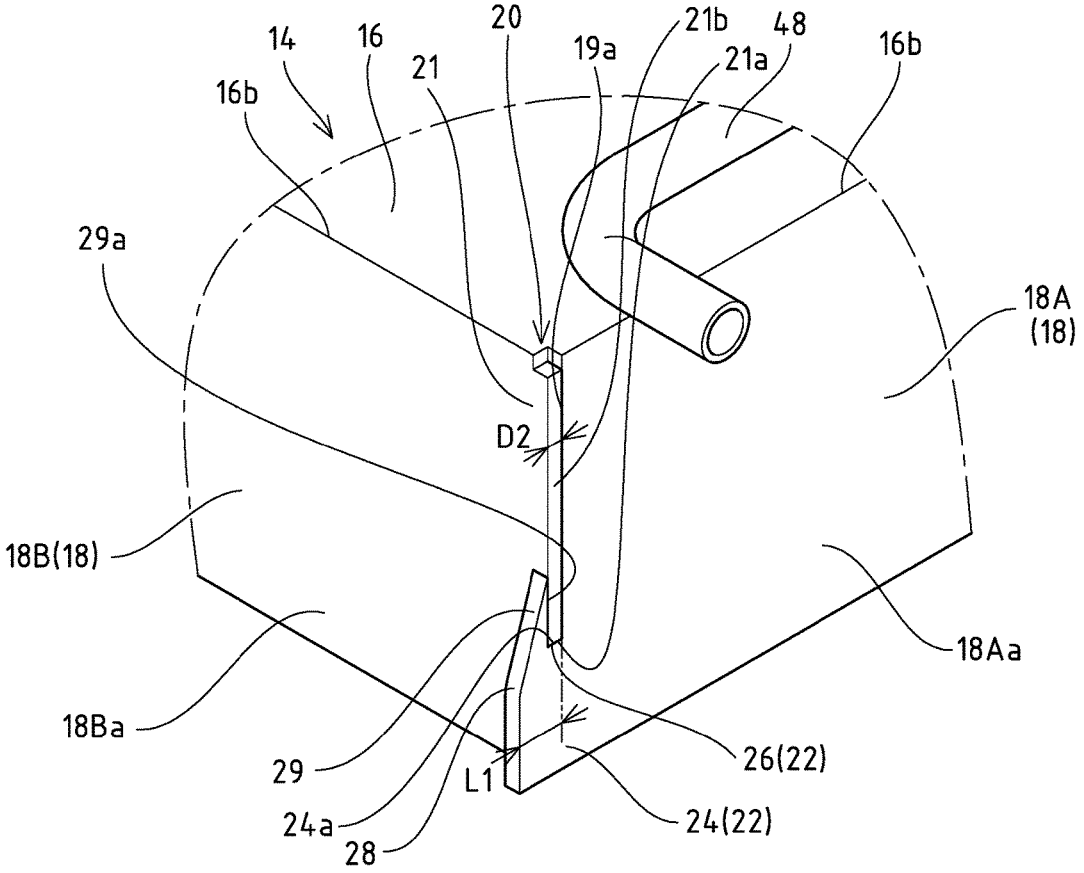
FIG. 7A is an enlarged perspective view of a corner portion of an outer frame according to a further embodiment.
Figure 7B:
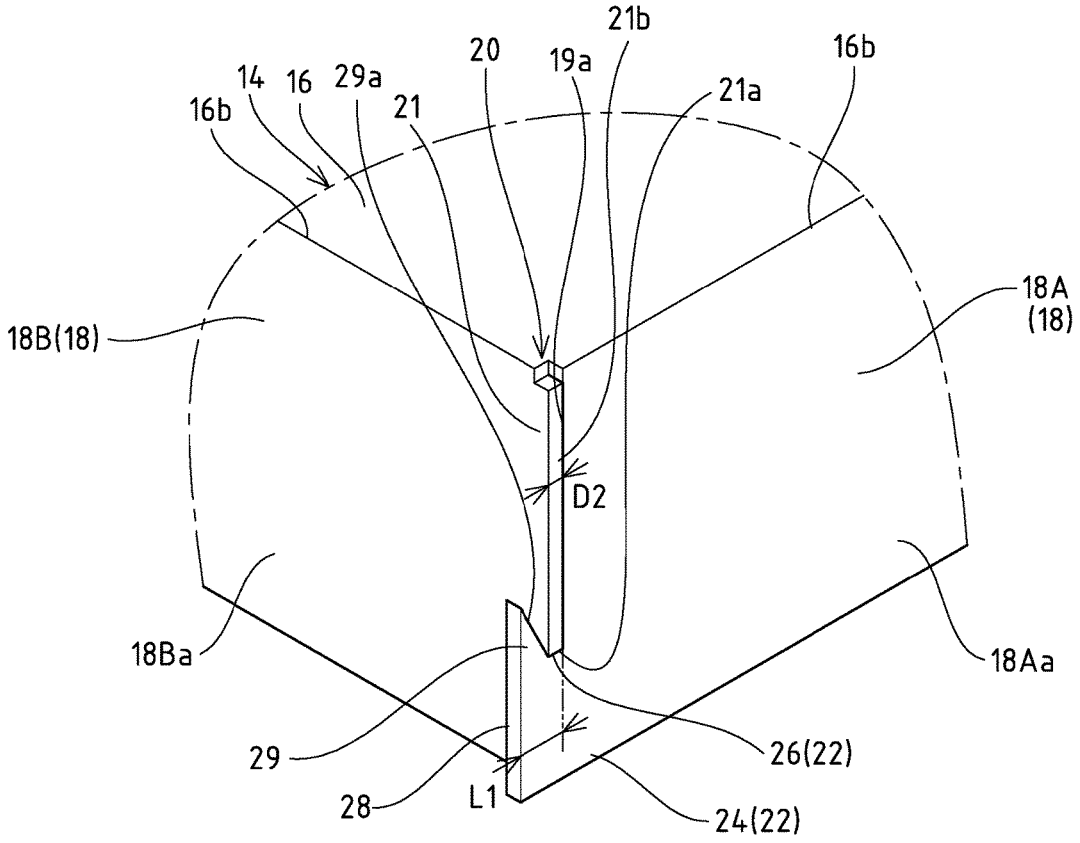
FIG. 7B shows a state before the extending portion is pressed.

The extending portion 24 provided on the side end portion of the first side plate 18A in the outer frame 14 shown in FIG. 7A extends outward beyond the outer surface 18Ba of the second side plate 18B, and projects upward above the notch portion 26 of the second side plate 18B. A projection 29 projecting upward above the notch portion 26 of the second side plate 18B (that portion of the extending portion 24 which is fitted into the notch portion 26) is provided at the extending end portion 28 of the extending portion 24 in this manner, and the projection 29 is pressed so as to abut on the upper portion of the notch portion 26 (mainly the outer surface of the projection 21) of the outer surface 18Ba of the second side plate 18B.

Figure 8A:
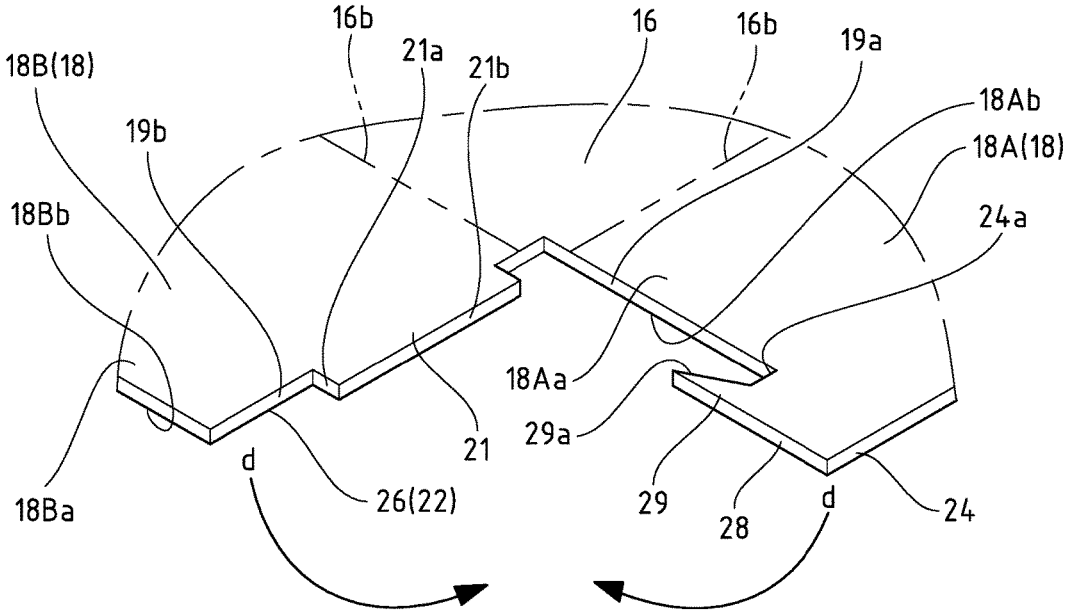
FIGS. 8A to 8C are explanatory views of a step of forming an outer frame shown in FIGS. 7A and 7B.
Figure 8B:
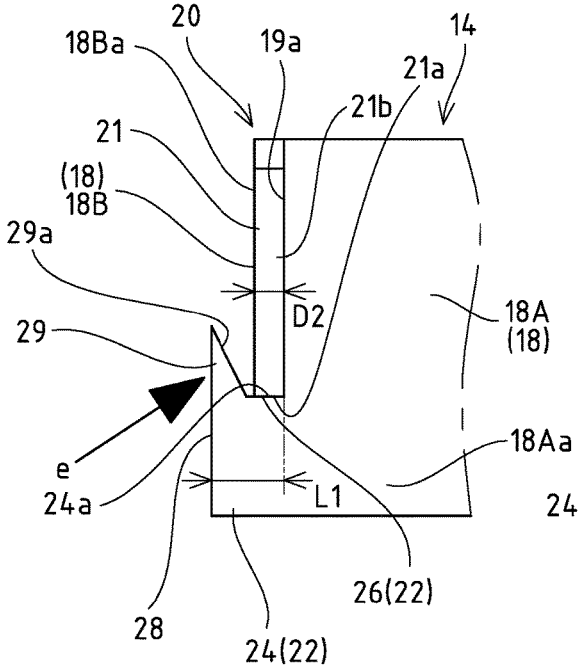
Figure 8C:
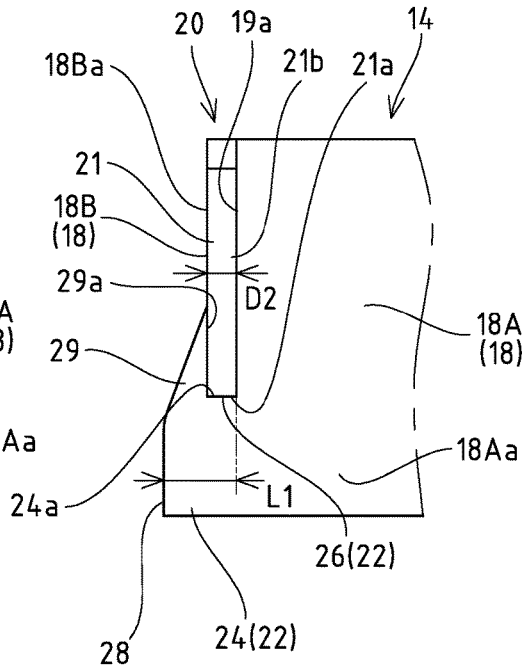

In the state before bending the side plate 18 with respect, to the top plate 16, the extending end portion 28 of the extending portion 24 shown in FIG. 8A is extended on the same plane as the surface of the first side plate 18A in such a way that the extension length L1 of the extending portion 24 from the first side end face 19*a* is greater than the thickness D2 of the second side plate 18B, and the extending portion 24 is provided with an inclined surface 29*a* whose inclination angle is increased in the extending direction. That is, a triangular projection 29 projecting upward above that portion of the extending portion 24 which is received in the notch portion 26 and having the inclined surface 29*a* is provided on the extending end portion 28 of the extending portion 24. When the side plates 18 are bent along the respective sides 16*b* of the top plate 16, the extending portion 24 of the outer frame 14 shown in FIG. 8B, which is formed on the side end portion of the first side plate 18A, is received in a contact state in the notch portion 26 formed on the side end portion of the second side plate 18B. With the extending portion 24 being fitted in the notch portion 26, the extending end portion 28 of the extending portion 24 extends outward beyond the outer surface 18Ba of the second side plate 18B, and the projection 29 extends upward above the notch portion 26. At this time, the inclined surface 29*a* of the projection 29 faces the outer surface 18Ba of the second side plate 18B (the outer surface of the projection 21), so that the distance between the inclined surface 29*a* and the outer surface 18Ba of the second side plate 18B gradually increases upward. Next, the extending end portion 28 of the extending portion 24 is pressed to the outer surface 18Ba of the second side plate 18B by the corner forming machine or the like, as indicated by an arrow e in FIG. 8B, so that the inclined surface 29*a* is crushed to abut, on the outer surface 18Ba of the second side plate 18B as shown in FIG. 8C. In this way, the area of adhesion between the first side plate 18A and the second side plate 18B of the outer frame 14 is extended in the height direction by the projection 29 being pressed.

In the ice compartment 10 shown in FIGS. 7A to 8C, the extending end portion 28 of the extending portion 24 has the projection 29 pressed so as to project upward and abut on the outer surface 18Ba of the second side plate 18B, so that the fitting of the extending portion 24 into the notch portion 26 becomes stronger. That is, as the area of adhesion between the first side plate 18A and the second side plate 18B is extended in the height direction by the projection 29 being pressed, the structural joint strength of the corner portion 20 of the outer frame 14 is enhanced, thus making it possible to effectively prevent the corner portion 20 of the outer frame 14 from being disjoined. Further, the inclination angle of the inclined surface 29*a* of the projection 29 is increased in the extending direction of the extending portion 24, so that when the first side plates 18A are bent with respect to the top plate 16, the projections 29 do not interfere with the second side plates 18B. As the joint strength of the corner portion 20 of the outer frame 14 is enhanced by the work of extending the extending portion 24 and pressing the extended extending end portion 28 by means of the corner forming machine or the like, which does not require a skill, the quality can be stabilized and the effect of lowering the manufacturing cost can be expected.

Modifications

The ice compartment described in connection with FIGS. 3A to 8C is not limited to the above-described configuration, and may be modified as follows.

(1) Although the extending portion is formed on the end portion of one side plate, the extension length of the extending portion may be smaller or larger than the thickness of the other side plate. That is, at least a part of the extending portion may be received in at least a part of the notch portion. To increase the strength of fitting the extending portion into the notch portion from the viewpoint of the joint strength, it is preferable to make the extension length of the extending portion larger than the thickness of the other side plate.

(2) The shape of the notch portion and the shape of the extending portion which is received in the notch portion may be triangular or the like, for example.

(3) In the extending portion formed on one side plate, the shape of the extending end portion bent so as to abut on the other side plate is not limited to a rectangular shape, and may be a triangular shape or the like, for example,

DESCRIPTION OF REFERENCE NUMERALS

10 Ice compartment
12 Small ice compartments
14 Outer frame
16 Top plate
17 Basis material
18 Side plates
18A First side plate (one side plate)
18B Second side plate (the other side plate)
20 Corner portion
23 Electroless nickel-phosphorus plated coating
24 Extending portion
26 Notch portion
29*a* Inclined surface
30 Partition member
30*a* Horizontal partition plate
30*b* Vertical partition plate
40 Water tray
46 Refrigeration system
48 Evaporator (cooling pipe)

The invention claimed is:

1. An automatic ice maker for producing ice having a required shape by supplying ice-making water in circulation to an ice compartment that is cooled by an evaporator, characterized in that an electroless nickel-phosphorus plated coating containing a 10% to 15% phosphorus component is formed in a thickness of 15 μm or more on an outermost layer of the ice compartment, the ice compartment includes the box shaped outer frame formed by bending the side plates extending from four sides of the top plate, in a same direction along the individual sides of the top plate, and the partition member disposed inside the outer frame in the lattice shape to define the plurality of small ice compartments, ends of the two side plates set adjacent to each other by the bending form a corner portion of the outer frame, an extending portion is formed on the end of the one side plate that faces the corner portion, and a notch portion that accommodates the extending portion in a contact state is formed on the end of the other side plate.

2. The automatic ice maker according to claim 1, wherein the electroless nickel-phosphorus plated coating is directly formed on an outer surface of a basis material of the ice compartment.

3. An automatic ice maker comprising:

an ice compartment having a plurality of small ice compartments defined by disposing a partition member formed by assembling a plurality of horizontal partition plates and vertical partition plates in a lattice shape to an outer frame including a top plate and side plates, the small ice compartments being open downward;

an evaporator disposed on the top plate of the outer frame and cooling the ice compartment by circulating a refrigerant supplied from a refrigeration system; and a water tray openably closing the ice compartment from under to supply ice-making water to each of the corresponding small ice compartments, wherein an electroless nickel-phosphorus plated coating is applied to the ice compartment including the partition member and the outer frame, and wherein a portion of the partition member joined to the top plate of the outer frame is formed straight, and the partition member and the top plate are joined together by brazing with a soft solder or a hard solder.

4. An automatic ice maker comprising:

an ice compartment having a plurality of small ice compartments defined by disposing a partition member formed by assembling a plurality of horizontal partition plates and vertical partition plates in a lattice shape to an outer frame including a top plate and side plates, the small ice compartments being open downward;

an evaporator disposed on the top plate of the outer frame and cooling the ice compartment by circulating a refrigerant supplied from a refrigeration system; and a water tray openably closing the ice compartment from under to supply ice-making water to each of the corresponding small ice compartments, wherein an electroless nickel-phosphorus plated coating is applied to the ice compartment including the partition member and the outer frame;

wherein a portion of the partition member joined to the top plate of the outer frame is formed straight, and the partition member and the top plate are joined together by brazing with a soft solder or a hard solder; and wherein joining the partition member and the top plate by the hard solder is achieved by furnace brazing in a heating furnace.

5. The automatic ice maker according to claim 2, wherein the ice compartment includes the box shaped outer frame formed by bending the side plates extending from four sides of the top plate, in a same direction along the individual sides of the top plate, and the partition member disposed inside the outer frame in the lattice shape to define the plurality of small ice compartments, ends of the two side plates set adjacent to each other by the bending form a corner portion of the outer frame, an extending portion is formed on the end of the one side plate that faces the corner portion, and a notch portion that accommodates the extending portion in a contact state is formed on the end of the other side plate.

6. The automatic ice maker according to claim 3, wherein the ice compartment includes the box shaped outer frame formed by bending the side plates extending from four sides of the top plate, in a same direction along the individual sides of the top plate, and the partition member disposed inside the outer frame in the lattice shape to define the plurality of small ice compartments, ends of the two side plates set adjacent to each other by the bending form a corner portion of the outer frame, an extending portion is formed on the end of the one side plate (18A) that faces the corner portion, and a notch portion that accommodates the extending portion (24) in a contact state is formed on the end of the other side plate.

7. The automatic ice maker according to claim 4, wherein the ice compartment includes the box shaped outer frame formed by bending the side plates extending from four sides of the top plate, in a same direction along the individual sides of the top plate, and the partition member disposed inside the outer frame in the lattice shape to define the plurality of small ice compartments, ends of the two side plates set adjacent to each other by the bending form a corner portion of the outer frame, an extending portion is formed on the end of the one side plate that faces the corner portion, and a notch portion that accommodates the extending portion in a contact state is formed on the end of the other side plate.

* * * * *